US011749042B2

(12) United States Patent
DeMattio

(10) Patent No.: US 11,749,042 B2
(45) Date of Patent: Sep. 5, 2023

(54) ACCESS CONTROL SMART SYSTEM

(71) Applicant: Kevin DeMattio, Hermosa Beach, CA (US)

(72) Inventor: Kevin DeMattio, Hermosa Beach, CA (US)

( * ) Notice: Subject to any disclaimer, the term of this patent is extended or adjusted under 35 U.S.C. 154(b) by 0 days.

(21) Appl. No.: 17/847,165

(22) Filed: Jun. 22, 2022

(65) Prior Publication Data

US 2023/0154261 A1 May 18, 2023

Related U.S. Application Data

(63) Continuation of application No. 17/835,062, filed on Jun. 8, 2022.

(60) Provisional application No. 63/279,235, filed on Nov. 15, 2021.

(51) Int. Cl.

| | |
|---|---|
| ***G07C 9/22*** | (2020.01) |
| ***G07C 9/21*** | (2020.01) |
| ***G07C 9/27*** | (2020.01) |
| ***G07C 9/00*** | (2020.01) |
| ***G07C 9/28*** | (2020.01) |

(52) U.S. Cl.

CPC ..... *G07C 9/22* (2020.01); *G07C 9/00309* (2013.01); *G07C 9/00896* (2013.01); *G07C 9/21* (2020.01); *G07C 9/27* (2020.01); *G07C 9/28* (2020.01); *G07C 2009/00769* (2013.01); *G07C 2209/63* (2013.01)

(58) Field of Classification Search

CPC .. G07C 9/22; G07C 9/00309; G07C 9/00896; G07C 9/21; G07C 9/27; G07C 9/28; G07C 2009/00769; G07C 2209/63

See application file for complete search history.

(56) References Cited

U.S. PATENT DOCUMENTS

| | | | | |
|---|---|---|---|---|
| 10,573,106 | B1 * | 2/2020 | Brady | G06V 40/1365 |
| 2004/0133789 | A1 * | 7/2004 | Gantman | G06Q 20/4014 713/189 |
| 2016/0284139 | A1 * | 9/2016 | Klein | G07C 9/00309 |
| 2020/0186962 | A1 * | 6/2020 | Moeller | H04L 9/3226 |
| 2020/0351661 | A1 * | 11/2020 | Kuenzi | G06Q 30/0267 |
| 2022/0130190 | A1 * | 4/2022 | Julia | G07C 9/00571 |
| 2022/0254212 | A1 * | 8/2022 | Schoenfelder | G07C 9/257 |

* cited by examiner

*Primary Examiner* — Nabil H Syed
(74) *Attorney, Agent, or Firm* — Richard B. Cates

(57) ABSTRACT

The invention is a device, system, and method for access control, including a combination of access control, live video communication, interactive virtual host, internal compound mapping, digital couponing, vacancy information, security system, maintenance requests, and administrative tracking and control.

20 Claims, 11 Drawing Sheets

FIGURE 4A
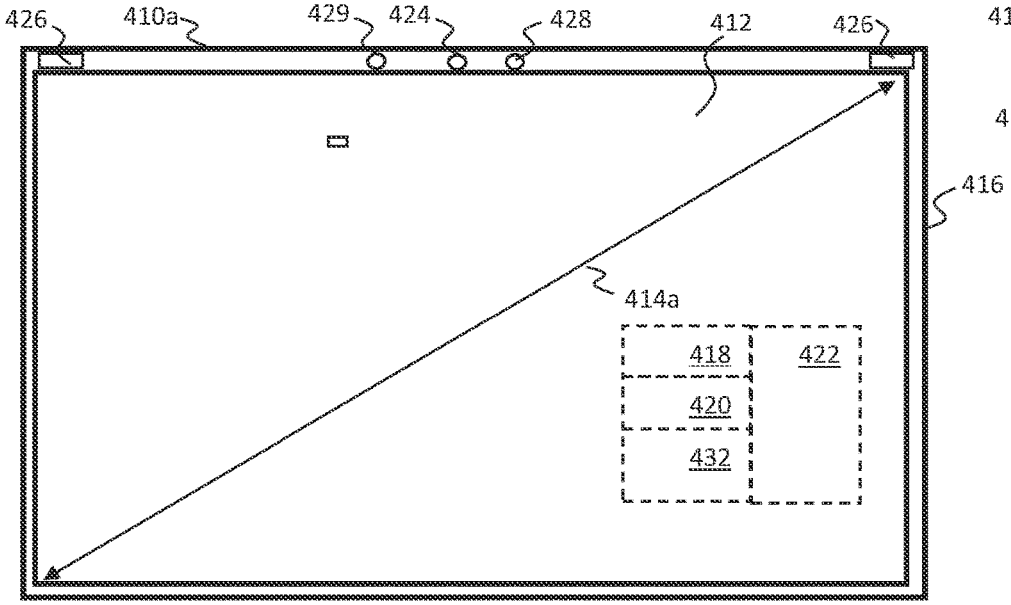
FIGURE 4B
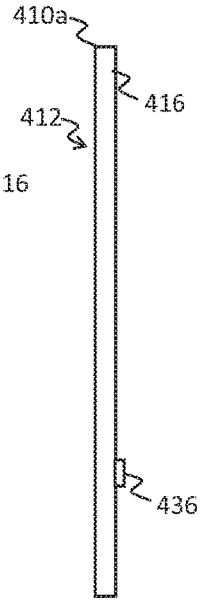
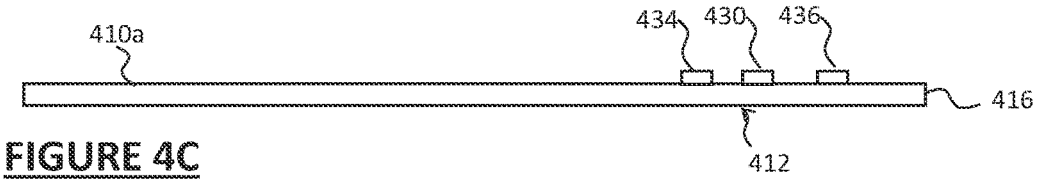
FIGURE 4C
FIGURE 5
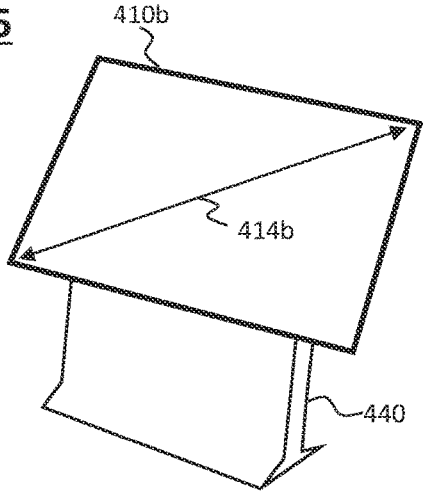

FIGURE 11E

Verizon 9:01PM 31%

< Food and Drink

E El Gringo
2620 Hermosa Ave
Hermosa Beach, CA 90254
(310) 376-1381

F Fish Shop
719 Pier Ave
Hermosa Beach, CA 90254
(310) 372-3480

J Jus' Poke
501 N Pacific Coast Hwy
Hermosa Beach, CA 90254
(310) 379-1133

N North End Bar
2626 Hermosa Ave
Hermosa Beach, CA 90254
(310) 379-5379

R ROK Sushi
1200 Hermosa Ave
Hermosa Beach, CA 90254
(310) 798-4765

T The Hook & Plow
425 Pier Ave

FIGURE 11F

Verizon 9:02PM 31%

<Food and Drink Jus' Poke 5 5% Anytime Discount

EXPIRES
Sep 11, 2021

DETAILS
5% off all items 10 10& OFF 3 + entrees

EXPIRES
Sep 11, 2021

DETAILS
Family Deal

FIGURE 11G

Verizon 9:02PM 31%

Cancel New Digital Key SEND

Choose recipient and a valid time frame for this digital key and the recipient will automatically be emailed a key Pick recipient from address book...

Recipient _____

Email _____

Start Date/Time March 11, 2020 at 9:02..>

End Date/Time March 12, 2020 at 9:02P.>

Notes _____

FIGURE 11H

Verizon 9:02PM 31%

Invictus Lifestyle

NOTIFICATIONS MAINT REQUESTS HEALTH

M Missed Video Chat Call
Monday, February 24, 2020 at 6:49 PM

P Pool Improvements
Monday, February 24, 2020 at 3:45 PM

T Torn Carpet was Updated
Monday, February 24, 2020 at 3:43 PM

T Torn Carpet was Updated
Monday, February 24, 2020 at 3:31 PM

T Torn Carpet was Updated
Monday, February 24, 2020 at 3:31 PM

B Broken sink was Updated
Monday, February 24, 2020 at 3:31 PM

B Broken sink fac was Updated
Monday, February 24, 2020 at 3:30 PM

ACCESS CONTROL SMART SYSTEM

RELATED APPLICATIONS

The present application claims priority from U.S. Provisional Patent Application No. 63/279,235, filed Nov. 15, 2021 and entitled "Access Control Smart System," and is a continuation of U.S. Utility patent application Ser. No. 17/835,062, entitled "Access Control Smart System with Resident and Non-Resident Apps," the entire contents of each of which are incorporated herein by reference.

TECHNICAL FIELD

The present disclosure relates to access control systems, and, more particularly, to systems and methods for accessing controlled spaces such as apartment and office complexes.

BACKGROUND

Access-controlled buildings and complexes are relatively commonplace, where only authorized personnel are allowed to access such spaces within such facilities. Some complexes provide on-site security personnel to provide access. However, employing such security personnel can be expensive, and often require access only via a single access point and/or only during specified hours, which may not be sufficient for multi-unit complexes. Various automated access systems have been developed, such as where access is provided responsive to a tenant/visitor possessing an access control device such as a key. For example, some access control systems rely on the use of a key card or key fob to enter the access-controlled location. Reliance on a key card or key fob can be an inconvenience to the resident should he/she lose the device, with the potential to being locked out. Also, such devices may be subject to misuse to permit unauthorized access, such as where an unauthorized person steals or otherwise gains possession of a key card or key fob. Moreover, non-residents (such as visitors and vendors) may not have access to such key fobs/key cards. And it may be desirable to limit the access of non-residents (e.g., visitors and vendors) to certain areas of the facility, while denying such non-residents access to some areas that are accessible to residents. Moreover, it may be desirable to have ongoing and/or tailored communication abilities with residents and non-residents.

Some automated access control systems work in conjunction with access boxes, including access boxes which provide information to a visitor about a specific tenant in an access-controlled building/complex. For example, some access boxes provide a listing of building tenants, with the option for a visitor to place a call via the access box to a desired tenant. However, it is often the case that a visitor/delivery service/repair person is unable to locate the correct unit and/or unable to contact the tenant (such as where the tenant is away from the facility). Without such access, repair personnel may be unable to provide a needed repair. Sometimes a visitor/delivery service/repair person may wander into an unauthorized area of the facility. Delivery services may have to leave deliveries outside the access-controlled location, or at a central mailbox—instead of at the desired tenant's apartment or office or in other secure delivery location.

There is a need for access control systems and methods with improved and enhanced capabilities to provide access to controlled areas. The current technology fulfills this need.

SUMMARY

The present technology relates to systems, devices, and methods for providing tenant and third-party (e.g., visitor, maintenance personnel, delivery personnel) access to controlled areas such as in apartment and office complexes. Such access can be provided to tenants and 3$^{rd}$ parties of access-controlled buildings and complexes, including individual residents/vendors/repair personnel/delivery personnel/visitors of apartment and/or office complexes.

Systems and methods of the technology may work in conjunction with a kiosk, through which tenants and/or 3$^{rd}$ parties can enter information to gain access, and through which individuals can obtain information about and/or get in contact with a specific tenant within the facility. The kiosk interacts with an app on a resident's smart phone via a hosting network system, such as via the internet/cloud. The kiosk can also interact with an app on a non-resident's smart phone (e.g., a visitor's smart phone, delivery person smart phone, maintenance worker smart phone, etc.) via a hosting network system, such as via the internet/cloud.

In one embodiment, an access control smart system works in conjunction with at least one kiosk at an access point to the facility, as well as with an application designed for use on a mobile communication device. The overall control smart system may be controlled by an administrator/management company at a central location, which may be located at or away from the access-controlled facility. Such central location may be accessed from the kiosk and/or the mobile communication device/app via a cell phone connection, wireless connection, internet, the cloud, etc. The overall control smart system may be hosted by a remote host server.

The initial setup for a new user begins when the management company sends an electronic invitation, such as via email, text, etc., to the new resident inviting the new resident to join the access control smart system. The electronic invitation prompts the resident to identify the operating system of their mobile communication device such that it can direct the resident to the appropriate online store to download the required application. After the application is successfully downloaded, the resident will register with the system using the information provided within the electronic invitation. The information provided may include identification of the particular access-controlled facility, identification of the particular resident, identification of the particular unit occupied by the resident, and/or security codes (aka PIN codes) used to verify the legitimacy of the registration. Once registration is complete and the identity of the resident is confirmed, the resident will be given a digital key. The access control smart system will recognize the resident whenever the application installed is opened and the digital key is entered.

The access control smart system has the ability to control entry into an access-controlled location. The access-controlled location may have one or more entry gate (e.g., pedestrian gate or pedestrian door or garage door) through which to enter the location. The entry gate is comprised of an electronic locking mechanism that controls entry and works in conjunction with a kiosk connected to the system. The kiosk may be hard-wired to the entry gate, and/or in communication with the entry gate via a wireless connection (e.g., Bluetooth, cellular, internet/cloud, etc.). The electronic locking mechanism operates in response to receiving information from the system, such as info received directly from the kiosk, etc. The system is activated when the resident opens the application on his/her mobile communication device as he/she approaches the kiosk. The resident selects the necessary option (e.g., open gate) on the application. (Note that the resident may also or alternatively input (via the smart phone and/or kiosk) a user-specific access code to enter the access-controlled location.) The system will respond by initializing the electronic locking mechanism to unlock the gate thus granting entry. The entry gate will remain accessible for entry only for a specific time limit. Once that time limit has been exceeded, and/or if the entry gate has been opened and reclosed (as where the user has passed through the gate), the system will re-engage the locking mechanism, preventing entry into the access-controlled location.

The access control smart system also has the ability to remotely control entry into an access-controlled location by utilizing a digital key, such as a guest code key. The digital key is a key code generated by the system user to be used by a resident or 3$^{rd}$ party to gain entry. The 3$^{rd}$ party can be a guest of the resident, a delivery service, vendor providing maintenance, etc. In one instance, the resident opens the application installed on their mobile communication device and selects the option to send a digital key to a 3$^{rd}$ party (e.g., visitor, vendor, etc.). The resident enters the required information directing where the digital key will be sent. In another instance, the local management company accesses the system from their central location (e.g., via the administrator portal) and prompts the system to send a digital key to an individual (such as a repair person) to be used to gain entry, such as via a specific gate or gates and/or at a specific time period (e.g., between 9 am and 10 am on a specific date). The system will send an electronic message containing the guest key code to the directed recipient. Upon arrival, the 3$^{rd}$ party to whom the digital key was provided will activate the system at an access point kiosk and select the option to use the digital key. The 3$^{rd}$ party will be prompted to enter the digital key/guest key code. Once the system verifies that the correct code has been entered, the system will initialize the electronic locking mechanism to unlock the gate thus granting entry. The entry gate will remain accessible for entry only for a specific time limit. Once that time limit has been exceeded, and/or if the gate has been opened and then reclosed after being unlocked, the system will re-engage the locking mechanism to prevent entry into the access-controlled location.

To set keys, an administrator can access the system via a facility portal (such as via a company computer) and login, as described above, and select "Keys" or a similar action item from a header menu. A screen (e.g., of the company computer) may display all created keys and for what vendors they were created with timestamps. The administrator can manage the current keys by selecting a particular key and editing it as necessary, including revoking the key and/or changing access areas and times for a designated key. The administrator can also have the system generate a new key, or the administrator can select and enter a new key, which can be provided to a user such as a resident or guest (e.g., vendor, repairman, etc.). The facility administrator can also select which gates/doors/areas of the complex are granted to be accessed with a particular key, and/or the times of access of areas of the complex by a particular key. For example, a swimming pool maintenance vendor may have a key granting access only to gates and/or doors leading to the swimming pool; Gardeners could have a key granting access only to exterior gates and only on certain days and at certain hours; Resident and visitor children known to be under a certain age (e.g., 12) could have keys which will not open doors leading to a swimming pool.

Note that a resident or other user may also have the option to set the actual number/code of their particular access key, such as via the user's smart phone and app.

As mentioned previously, the access control smart system works in combination with at least one access point kiosk and an application installed onto a mobile communication device. The system allows for live communication, such as audio and/or video communication, between 3$^{rd}$ party located at the kiosk and a user (e.g., resident) utilizing a mobile communication device. On one end (e.g., the non-resident such as visitor or other 3$^{rd}$ party), there is a video camera and microphone located at the kiosk set to record, while at the other end (e.g., the resident) the application accesses the video camera integrated with the mobile communication device. The visitor located at the kiosk will activate the system, and in response the system will present the 3$^{rd}$ party with the option to contact a resident. Once the desired resident is selected by the 3$^{rd}$ party, the system will contact that resident via the resident's mobile communication device. The application on the mobile communication device will present a notification to the resident to open the application. Once the application is opened, an image taken by the kiosk video camera of the 3$^{rd}$ party located at the kiosk will appear, allowing the resident to see/identify the 3$^{rd}$ party. The resident then has the option to either accept or decline the request to audio and/or video conference. If the resident accepts the request, the 3$^{rd}$ party and resident will be able to speak directly to each other in real time. The resident then has the ability (e.g., using the app on the resident's mobile communication device) to prompt the system to initialize the electronic locking mechanism and grant the 3$^{rd}$ party entry into the access-controlled location. If the resident declines the request, the system will respond by notifying the 3$^{rd}$ party that the resident is not available, and may present the 3$^{rd}$ party with the option to leave a video and/or audio voicemail and/or text message.

Such video communication also has the ability to act as a security camera system. The camera at the kiosk will take snapshot photos and/or live video of the kiosk user once the system is activated. The snapshot photo will be taken at specified intervals until the system is deactivated. The system will also record the search activity of the kiosk user.

The kiosk may have facial recognition capabilities, using images captured by the kiosk camera or other cameras interacting with the system. The kiosk could use facial recognition to identify a user, and grant (or deny) entry to the user based on such identification. Such facial recognition identification could be used in addition to, or in lieu of, the other entry methods of the embodiments (e.g., key code entry, smart phone location/proximity, etc.). For example, a system could grant entry to a user who enters a key code and who is also identified by the kiosk using facial recognition.

The kiosk can act as an emergency call system. Should there be an emergency, the user has the ability to notify the system of such by pressing an emergency button present on the kiosk display. The camera system will record any events occurring around the vicinity of the kiosk within camera view, and may notify the user of the recording activity. The kiosk may also prompt the user whether the situation requires emergency services and if so to make an appropriate selection (e.g., re-select the emergency button) whereby the system will contact 9-1-1. The recording and photographs/video may be stored within a cloud-based network accessible at any time, and/or stored locally with the facility management company (e.g., on a local computer).

A virtual host is also a part of the access control smart system. The virtual host will activate upon a visitor initializing the system at an access point kiosk. The virtual host acts as a concierge that interacts with the visitor. The virtual host presents system options for the visitor to select. One option allows the visitor to locate and contact a resident to enter the access-controlled location. Another option allows for the visitor to enter a digital key code to gain entry. Once access is granted, the virtual host will provide detailed mapping and directions to the requested unit.

The virtual host can also provide information regarding vacancy within the gated community. Such information may include price, availability, size/footage, features, layout, and pictures of the vacant unit in question. In response, the user of the kiosk can enter information requesting to be put in contact with, and/or to be contacted later, by the management company.

The access control smart system may also allow interaction between the resident and businesses (such as local stores and/or restaurants), including providing advertisements (e.g., coupons) for such businesses. The access control smart system can track coupon and/or other user interaction with the business. The management company and/or remote host can charge businesses for advertisements based on user interaction with a business, such as being based on system-provided coupon usage at the business.

Another option available to be selected by the user of the kiosk is the ability to select digital coupons. The virtual host will present digital coupons associated with local vendors. The user selects a vendor and the virtual host will display the coupon on the kiosk screen from which the user can take a picture of the coupon to be later presented to the vendor. The ability to select digital coupons is also available to the resident via the application on his/her mobile communication device. The resident can select the digital coupon option whereby all relevant coupons will be displayed. The resident can then take a screenshot photo of the coupon to be later presented to the vendor. Such coupons may be provided at the request of local vendors, who may pay the system control company and/or facility management company or another entity up front a fee in order for the vendor's coupons to be provided via the kiosk, and/or may pay the system control company and/or facility management company or another entity a fee when the coupon is actually used at the vendor's operation.

The access control smart system also allows for interaction between the resident and the facility management company. For example, the resident can submit a maintenance request via the application installed on his/her mobile communication device which is then received by the management company at the centralized location. The management company can use the system to schedule an appropriate time in which they can respond to the resident's request. The resident can either confirm or suggest an alternate time for the work to be performed. After the work has been completed, the resident can use the system to leave feedback regarding the quality of work done or any other information he/she wants to provide.

Non-residents may be provided with different smart phone apps from the resident smart phone apps, with the non-resident smartphone apps providing different information and access from that provided to residents. For example, non-resident apps may provide more limited facility information and more limited facility access than is provided to resident apps.

The centralized location of the system is accessible only by those who have administrative rights and privileges. This access gives management the ability to track all aspects of the system, whereby they can control the entry privileges of the residents and employees; and can communicate with the residents/employees by sending push bottom notifications connected to the system with their mobile communication device.

A system of the invention may provide access to a controlled area, and have a plurality of locks, each lock controlling access to a different access point of the controlled area; a host server configured to receive resident and visitor information, the host server adapted to generate access data for use in activating one or more of the plurality of locks; a cloud service server connected to the host server through an internet network, the cloud service server having a cloud storage; a kiosk positioned at the controlled area, the kiosk connected to the cloud service server via an internet connection, the kiosk comprising a kiosk app adapted to receive, the kiosk comprising a kiosk screen and a kiosk camera; a resident smartphone app adapted to be provided to a resident smartphone via an internet network, the resident smartphone app adapted to provide resident access information for one or more resident access points, wherein the resident access information is generated using the access data generated by the host server, wherein the resident access points comprise one or more of the access points for the controlled area; and a non-resident smartphone app adapted to be provided to a non-resident smartphone via the internet network, the non-resident smartphone app adapted to provide non-resident access information for one or more non-resident access points, wherein the non-resident access information may be generated using the access data generated by the host server, wherein the non-resident access points comprise one or more of the access points for the controlled area, wherein one or more of the resident access points are different from the non-resident access points. The non-resident access information may include an access code comprising numbers, letters, or both number and letters, and the non-resident smartphone app may be adapted to present the access code to a non-resident user via the non-resident smartphone. The kiosk may have a kiosk user input configured for a user to input data thereby, wherein the kiosk may be adapted to lock or unlock one or more of the plurality of locks responsive to the access code being input by a user via the kiosk user input. The kiosk user input and the kiosk screen may be a touchscreen.

The non-resident access information may be a visible access code image, and the non-resident smartphone app may be adapted to generate the visible access code image for presentation on a smartphone screen of the non-resident smartphone, and the kiosk may be configured to scan the visible access phone image via the kiosk camera, wherein the kiosk may be adapted to lock or unlock one or more of the plurality of locks responsive to the visible access phone image. The non-resident access information may be an audible access code, with the non-resident smartphone app adapted to generate the audible access code via a smartphone speaker of the non-resident smartphone. The kiosk may have a kiosk microphone, and the kiosk may be configured to receive the audible access phone image via the kiosk microphone. The kiosk may be adapted to lock or unlock one or more of the plurality of locks responsive to the audible access phone.

The non-resident smartphone app may be adapted to provide positioning date of the non-resident user smartphone, which may be used to generate non-resident alarms indicating that the non-resident is in an unauthorized area. The non-resident user smartphone positioning data may be provided to the kiosk or the host server., wherein the kiosk locks or unlocks one or more of the plurality of locks responsive to the non-resident user smartphone positioning data. The kiosk may be adapted to generate a non-resident position alarm responsive to the non-resident positioning data. The host server may be adapted to generate a non-resident position alarm responsive to the non-resident positioning data. The resident smartphone app may be adapted to generate a non-resident alarm via the resident smartphone responsive to the non-resident positioning data. The non-resident smartphone app may be adapted to generate a non-resident position alarm via the non-resident smartphone responsive to the non-resident positioning data. The system may comprise an administrative portal adapted to provide a non-resident position alarm responsive to the non-resident positioning data.

The resident smartphone app may be adapted to provide resident facilities information regarding the controlled area; and the non-resident smartphone app may be adapted to provide non-resident facilities information regarding the controlled area, wherein the non-resident facilities information may be different from the resident facilities information.

The controlled area may comprise a residential or commercial complex, and the non-resident facilities information may comprise availability and/or rental rates for units in the residential or commercial complex.

The non-resident smartphone app may be adapted to generate a map of at least a portion of the controlled area for presentation on a screen of the non-resident smartphone. The map may comprise a route for a non-resident to follow. The map may include a non-resident user location indicator, wherein the non-resident user location indicator may be generated responsive to the positioning data of the non-resident user smartphone. The route may be updated responsive to positioning data of the non-resident user smartphone. The non-resident access information for the one or more non-resident access points may be provided responsive to input by a resident user via the resident smartphone app and/or responsive to input by an administrator via an administrative portal.

Other objects, features, and advantages of the present technology will become apparent from a consideration of the following detailed description.

BRIEF DESCRIPTION OF THE DRAWINGS

Many aspects of the present disclosure can be better understood with reference to the following drawings. The components in the drawings are not necessarily to scale. Instead, emphasis is placed on illustrating clearly the principles of the present disclosure.

FIGS. 4A-4C depict front, side, and to views of a kiosk according to embodiments of the technology;

FIG. 5 depicts a perspective view of a kiosk according to embodiments of the technology;

FIG. 11E depicts a food and drink coupon screen according to an embodiment of the technology;

FIG. 11F depicts a vendor-specific coupon screen according to an embodiment of the technology;

FIG. 11G depicts a new digital key screen according to an embodiment of the technology;

FIG. 11H depicts a notifications screen according to an embodiment of the technology;

DETAILED DESCRIPTION

Various embodiments of the present technology are disclosed and depicted in the descriptions and figures herein.

Figure 1:
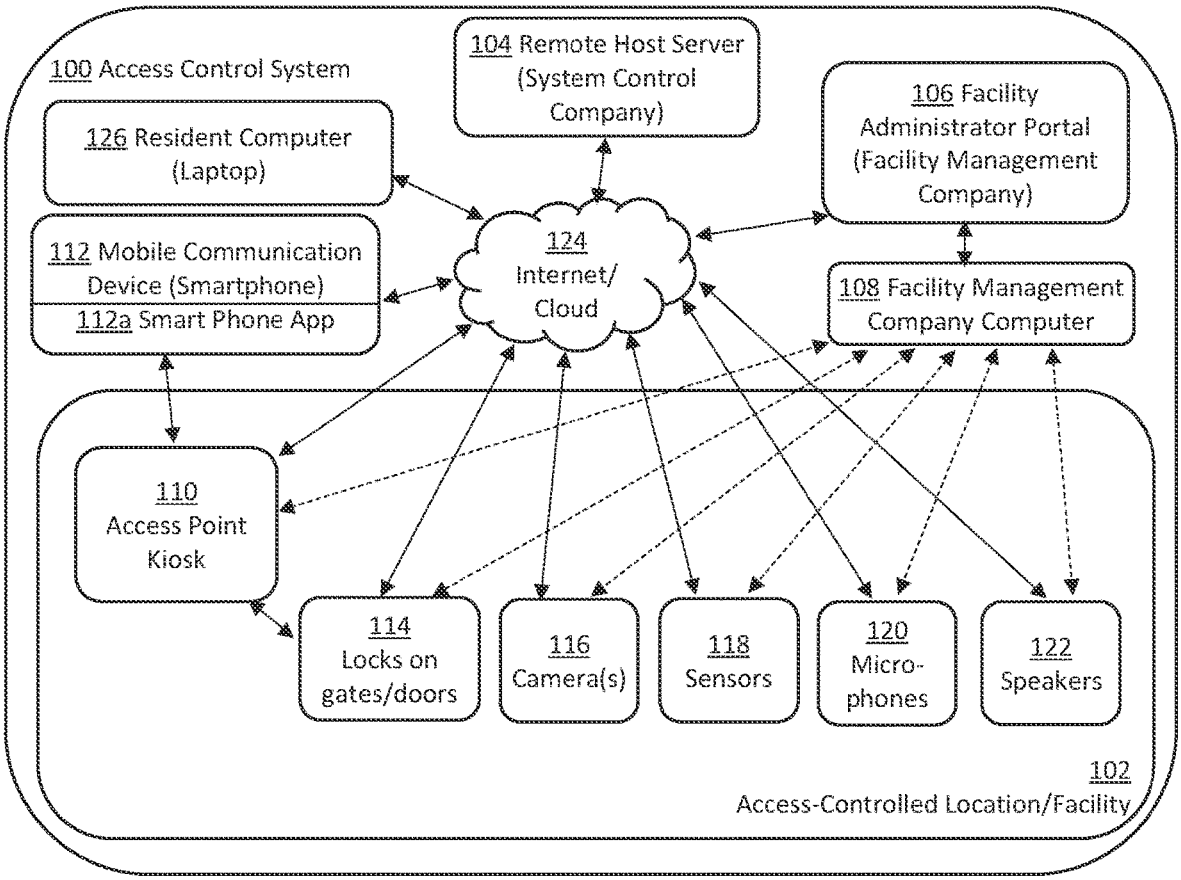
FIG. 1 depicts a schematic view of a system according to embodiments of the technology.

FIG. 1 depicts an access control system 100 according to embodiments, which controls access to an access-controlled facility 102 such as an apartment complex or an office complex. The access control system 100 may be controlled by a remote host server 104 operated by a system control company, which may control multiple smart systems for multiple facilities. The remote host server 104 may have overall control of all system components.

The particular access-controlled facility 102 may be managed/operated by a "local" facility management company, which may use a facility administrator portal 106 (e.g., accessed in an app on a computer 108 of the facility management company) to provide information to the remote host server 104 such as identification of residents, etc.

One or more access point kiosks 110 may be located at the access-controlled facility 102, with the kiosks 110 having a user input (e.g., a touchscreen) with which a user (e.g., residents, visitors, maintenance personnel, delivery personnel) can enter information into the kiosk, such as a passcode that will unlock a door or gate to grant the user access to the facility. Users may use their individual mobile communication devices 112 (e.g., smartphone) to interact with the system 100, such as via an app 112*a* installed on the smartphone 112. Locks 114 for access points (e.g., gates, doors, etc.) of the facility 102 may be controlled via the system 100. Other elements may be present at the facility, such as cameras 116, sensors 118 (e.g., motion sensors), microphones 120, and/or speakers 122, which may be used to monitor and communicate with persons (residents, visitors, other personnel) at the facility. Note that various cameras, sensors, microphones, and/or speakers may be part of a kiosk, and/or may be positioned at locations in the facility that are adjacent to or spaced away from a kiosk.

The various system components may communicate through the internet/cloud 124, such as via wireless (e.g., cellular) and/or wired (e.g., Ethernet/LAN) connections. Alternatively or additionally, some system components may communicate with each other via other methods, such as via direct-wired link (e.g., hardwire), local wireless transmission (e.g., Bluetooth), etc. For example, a smart phone or other mobile communication device 112 may communicate directly with a kiosk 110, such as via a Bluetooth connection and/or by providing images (e.g., PR or other bar codes) from the smart phone 112 screen to a camera of the kiosk 110 and/or receiving (via smart phone camera) images from a display screen of the kiosk 110. A lock 114 may be in direct wired or wireless (e.g., Bluetooth) communication with a kiosk 110, such as where the kiosk is positioned at or adjacent an access point controlled by the particular lock. The facility management company computer 108 may have direct communication (e.g., via wired or wireless connection) with local system components such as kiosks 110, locks 114, cameras 116, sensors 118, microphones 120, and/or speakers 122. Such direct communication may be helpful in cases of internet outage, etc.

A user's primary access to the system may be via an app on his/her smart phone 112. Additional access may be via a user's computer 126 (e.g., home/laptop computer), through which the user may access the system via the internet/cloud, such as when the user is in his/her apartment or office at the facility.

Examples of applicable access-controlled facilities include residential complexes, including apartment complexes, condominium complexes, gated communities (e.g., of single-family houses). Other examples of applicable access-controlled facilities include hotels and other temporary lodging facilities; office complexes; mixed-use complexes of offices, retail, lodging, and/or residential units; industrial complexes; construction sites; marinas; universities/colleges; storage facilities; government facilities (offices, military, etc.).

To open the access door/gate to the facility, a resident may open the app on his/her cell phone or other portable electronic device. The resident may choose the particular point of entry, such as where a facility has numerous access doors/gates. For example, the app may provide a selection option titled "Access Points", which can provide a list of the access doors/gates which the resident is authorized to use. The resident then chooses the appropriate point of entry. The resident may then be prompted by the app with a confirmation option, such as via selecting a "yes or no" to finalize opening the door/gate. The phone will then send a signal (e.g., via cell phone connection) to the cloud server, which will communicate to the computer within the location kiosk to trigger the relay to open the correct door/gate.

Alternatively, the smart phone may send the "open" signal directly to the kiosk, such as through a Bluetooth connection. The kiosk may interact with the host server to confirm that the "open" signal is authorized, and then open the point of entry if authorized—or deny entry and possibly activate an alarm (such as an audio warning, or sending a warning to security personnel) if the signal from the smart phone is unauthorized.

The system may have the capability to identify and/or contact specific persons who are considered to be of particular interest to the facility. For example, a previously-authorized user who is now unauthorized may be identified by the system (such as via the system detecting the presence of the unauthorized user and/or user's smart phone on the premises), and the system could take appropriate action—such as issuing a "leave the premises" or other warning to the unauthorized user (via user's smart phone or kiosk screen or speaker); notifying police or security or other facility personnel of the presence of the unauthorized user; or take other action. An authorized user may also be contacted by the facility using the system (such as via the system detecting the presence of the authorized user and/or user's smart phone on the premises), such as contacting a tenant whose rent is due or who has a delivery at the office or whose apartment/office needs maintenance. For example, if a particular user is indicated by the system as being adjacent a specific kiosk, that kiosk could initiate a message for that particular user, such as visual and/or audible messages.

Residents or other authorized users are also provided the option of entering an access code/digital key (e.g., a specific number or other information) into the kiosk to gain entrance. This permits a resident to gain entrance without having to have his/her phone at the time of entry. Prior to the resident attempting such access, the resident may request an access code, which may be requested using the kiosk or using the app on the user's electronic device (e.g., smartphone). Alternatively or additionally, the building management may request that such an access code be provided to the resident (such as when the resident first moves into the facility) or other authorized user (e.g., vendor, delivery personnel, repair personnel, etc.). The request (from management or the resident) goes to the system, which generates the access code, and provides the specific access code (e.g., PIN number) to the resident or other party to be granted access (e.g., by transmitting via the internet/cloud from the remote host server to the resident's or other user's portable communication device).

Such a specific access code may be specific to the particular resident or other user, so that each resident or other user will have a different specific access code. To use such a code, the resident or other user may approach and/or touch the kiosk to activate the kiosk. The resident or other user then makes an appropriate selection that allows the resident to enter the PIN to unlock the desired gate. For example, the resident or other user may select a Directory option on the kiosk screen, which may cause the kiosk to display a list of residents. The user can then find his/her profile (e.g., by sliding his/her finger along the list and/or tapping on the desired profile listing). Once the resident or other user selects the proper profile, the resident or other user may be given the option to enter the digital key. For example, the kiosk may provide a choice of a "video call or a Digital Key". The user will select the "digital key" option, then enter the user's specific access code, e.g., a 4-digit PIN. The kiosk computer will send a signal to the host system (e.g., cloud server), which will confirm the validity of the access code and communicate to the computer within the location kiosk to trigger the relay to unlock and/or open the correct door. Alternatively, once the host system confirms the validity of the access code, the host system may communicate to the relay itself (e.g., without going through the kiosk, such as where the communication is provided from the host to the relay via internet, wireless, etc.) to unlock and/or open the correct door.

To set keys, an administrator can access the system via a facility portal 106 (such as via the company computer 108)

and login, as described above, and select "Keys" or a similar action item from a header menu. A screen (e.g., of the company computer 108) may display all created keys and for what vendors they were created with timestamps. The administrator can manage the current keys by selecting a particular key and editing it as necessary, including revoking the key and/or changing access areas and times for a designated key. The administrator can also have the system generate a new key, or the administrator can select and enter a new key, which can be provided to a user such as a resident or guest (e.g., vendor, repairman, etc.). The facility administrator can also select which gates/doors/areas of the complex are granted to be accessed with a particular key, and/or the times of access of areas of the complex by a particular key. For example, a swimming pool maintenance vendor may have a key granting access only to gates and/or doors leading to the swimming pool; Gardeners could have a key granting access only to exterior gates and only on certain days and at certain hours; Resident and visitor children known to be under a certain age (e.g., 12) could have keys which will not open doors leading to a swimming pool.

The system may also provide the ability for a property administrator to send notifications to users (e.g., visitors, guests, vendors, etc.), which may be specific messages for a subset of users or to all users, etc. When a property administrator wants to create a notification to send out to the community as whole or to individual residents the following process would take place: The property administrator would log on to a portal 106 (such as via a management company computer 108, via an internet connection) to the remote host server 104, enter their credentials, and arrive at the particular facility administrator's home page. The facility administrator's home page, such as in a header, may have a menu with all relevant functions to the system for the particular facility. The property administrator can select the notification option and/or an option to create a notification, either as a notification to all residents or to a subset of one or more specific residents. For example, the property administrator may select "notification" on the home page; followed by "create notification", which then permits the property administrator to title the notification as well as complete the body of the message in the applicable space/appropriate field is provided. In one embodiment, if the property administrator selects no specific resident, the notification will go to all the authorized users (e.g., all the residents). If the property administrator wants to select a specific individual or specific individuals, they can do so—such as by holding down the control button while selecting the one or more individuals. When the property administrator clicks "create" at the bottom of the page, the notification is sent to the cloud 124, which in turn distributes it out to all the residents (e.g., via the residents' smartphones 112/the app 112*a*) assigned to that location ID. The resident's smartphone will then flash a banner of the new notification and/or an alert number on the home-screen app icon as a reminder later if not opened immediately. The resident can click on the banner to automatically open the app and be directed to the notification, or the resident can open the app itself, go to the notification tab, and then select the notification to be read. After the notification is read, the app may un-flag the notification and may also send a signal back to the cloud which will then relay the communication that the notification has been read by the resident, including a time-stamp of the date/time at which the notification was read.

A resident can make maintenance requests using the app on the resident's smartphone. A selection for maintenance requests may be provided on the app, such as a selection of "Maint Requests", through which the app while scroll to the appropriate maintenance request section. The app may list all requests made by the resident, such as via most recent first, and may include the current activity status, such as via designations such as Requested, Open, or Closed. If the resident selects a specific task, a further breakdown of that task may be provided, such as the assigned vendor and details gathered and added by the administration. If the resident would like to submit a new request, they can select such an option such as by simply hitting an option such as a "+" designation. This may open a new page in the app, with various fields ready for entry, and which may also include camera section. The resident can then title the request, describe it in a few words, and/or take/upload a photo (such as taking a photo of the device which requires repair/maintenance). When the resident is finished, hitting "save" can send the request up to the cloud 124, which would then communicate the request down to the location backend of the administrator. This will also create an alert on the resident's app home page to indicate a pending action is waiting for the administrator to move the stage of the project along. When the administrator has opened the task, and optionally, added in the details of the vendor assigned, the status can be updated for the resident. For example, once the status has been changed and the administrator saves the update, that status change will be sent back up to the cloud 124 and then down to the resident's mobile 112/app 112*a* as a notification. This update notification may follow the same viewing path as the aforementioned. Once the vendor has completed the task and submitted for completion to the admin office, the status may be changed once more, e.g., to "closed". This will again send an update notification to the resident's mobile 112/app 112*a*, which may also provide an option for the resident to input a review and rating on the vendor experience.

The system may also provide information of interest to the users (e.g., residents), which may be presented via kiosk and/or smart phone 112 (such as via a resident tab in the mobile app 112*a*) as a media center app portion. Such user-interest information may include different categories, such as news/entertainment shows, bulletin board, health and wellness, etc. Such information may be branded, such as with a 3D animated logo of the company operating the remote host server or operating the secure facility.

Entertainment/News in App:

Information such as a talk show or other entertainment may be provided. Such a show may highlight news such as the positive actions of people of all types making positive efforts in the world. Such a show may also provide Ad space to paid marketers.

Bulletin Board in App:

The bulletin board is an open forum for residents to buy or sell property or services. Within the smartphone app, the residents may take photos of goods to sell and post them for other building residents to see/buy. They may also post services such as dog walking, babysitting, cleaning, and other services. These postings may require approval by the server host or facility management prior to posting. The bulletin board may be accessed for viewing via the smartphone app and/or kiosk.

Health & Wellness Section in App:

A health and wellness section may be included to provide quick and easy access to healthy apartment workouts, easy to make meals, and other ways to help provide a healthier lifestyle to someone who may not have the time to go to the gym or look up recipes. These can be marked for favorites, and the host server and/or facility management can track which ones get the best traction to help guide the fitness pros with their content Renter Insurance Portal in App:

Advertise rental insurance to residents, and provide quick quotes for rental insurance (which is often required as a lease condition at many secure facilities). The renter insurance portal may collect limited data from resident in order to provide a quote on renters insurance. Referral fees may be provided from the insurance company to the host server company and/or to the building/facility management. Advertisements and quotes can be provided to the resident via kiosk and/or smartphone app.

Community Engagement Platform in App:

A community engagement platform may be provided to permit the host server and/or facility management or other authorized parties to send updates/alerts/announcements to users (e.g., residents) via user apps/smart phones. This can provide easier lines of communication about community updates and/or individual notifications, such as by giving easier access to important community events, updates, alerts, and resident issues. Read Receipts may be provided back to the host server and/or facility management. Specific messages can go out to the entire community or to specific individuals, sent by host server and/or facility management to kiosks and/or smartphone (via app). The read receipts can confirm which users (e.g., residents) have accessed the updates/alerts/announcements.

Rental Payment Portal in App:

The system may provide users with the ability to pay monthly and installments using smartphone app and/or kiosk. This provides the residents the ability to be flexible in how they pay their rent, debt or credit, and how often they pay throughout month to help with potentially handling their money. The app may interact (via cloud/internet) with 3$^{rd}$ party services for rent payment, such as via credit card, debit card, bank transfer, etc.

Figure 2:
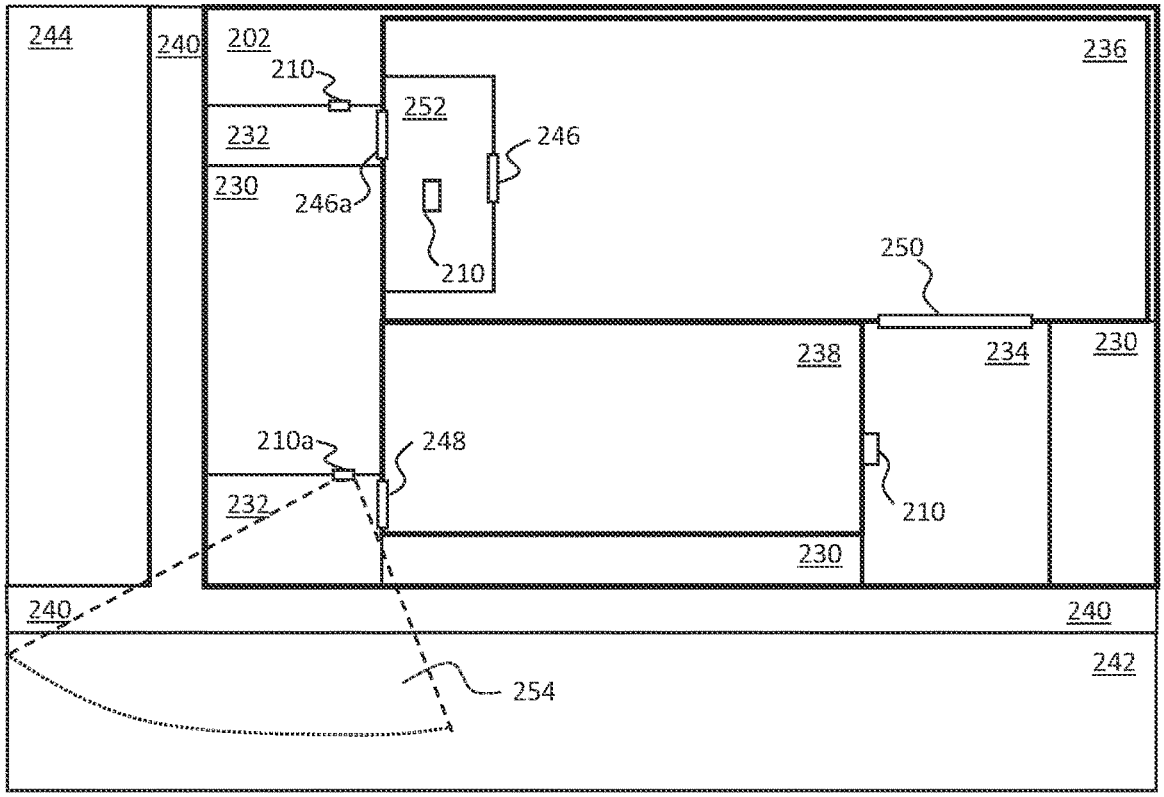
FIG. 2 depicts a schematic view of a secure facility according to embodiments of the technology.

As depicted in FIG. 2, an access-controlled facility 202 may include publicly-accessible (e.g., uncontrolled) areas such as lawn/garden space 230, entry walkways 232, driveways 234. The access-controlled facility 202 may further include secure (e.g., controlled) areas, such as internal secure areas 236 (e.g., building interiors, garages) and/or external secure areas 238 (e.g., outside areas such as swimming pools, courtyards, outside parking, etc.). There may also be publicly-accessible areas which are outside of the facility, such as adjacent sidewalks 240, roads 242, parks 244, etc. Internal secure areas 236 (e.g., building interiors, garages) and/or external secure areas 238 (e.g., outside areas such as swimming pools, courtyards, outside parking, etc.) may be accessed via one or more access points, such as pedestrian doors 246, pedestrian gates 248, automobile gates 250 (i.e., garage doors), etc. Kiosks 210 may be positioned at various positions, such as adjacent access points such as pedestrian doors 246, pedestrian gates 248, automobile gates 250, etc.

Note that some facility areas may change from being secure (controlled) areas to being publicly-available (uncontrolled) areas, and back again, such an entry lobby 252 that is unlocked and publicly accessible during daylight/business hours and is locked and secure (controlled) during evening/after-business hours, such as via a pedestrian door 246*a* that is time-controlled.

Kiosks 210 may be positioned so as to be easily visible by a user who approaches a corresponding access point 246, 248, 250. Some kiosks may also or alternatively be easily visible to passersby on public spaces outside of the facility, such as by passersby on adjacent sidewalks 240, roads 242, and/or parks 244. For example, kiosk 210*a* is positioned with sufficient visibility and size so as to provide a viewing area 254 which encompasses portions of the adjacent sidewalk 240 and road 242. In other words, a passerby within the viewing area 254 can see the kiosk 210*a* from the public areas 240, 242.

Positioning and otherwise adapting a kiosk 210*a* to provide the viewing area 254 which is visible from adjacent public spaces provides additional capabilities to the system, such advertising the facility and/or other businesses. While many apartment/office access systems have access kiosks/panels, such access kiosks/panels are typically positioned unobtrusively so that they are not easily visible by passersby in public areas, such as being positioned immediately adjacent an entrance point but in such a way that the kiosk/panel is not easily visible until a person closely approaches the door or gate that is controlled by the particular kiosk/panel. By contrast, some kiosks of the current system can be intentionally positioned to be visibly prominent to passersby on adjacent public spaces such as sidewalks and roads and parks. As discussed later in this application, a publicly-visible kiosk (e.g., 210*a* from FIG. 2) may include displays (e.g., active/moving graphics, etc.) and/or sounds which are adapted to draw the attention of passersby in the public space, and/or to attract/invite the passersby from the public space to approach, view closely, and/or interact with the kiosk. The publicly-visible kiosk 210*a* thus serves to provide facility access and advertising, etc., to authorized users (e.g., residents, visitors, vendors), and also to provide facility and/or 3$^{rd}$ party advertising to passersby.

Figure 3:
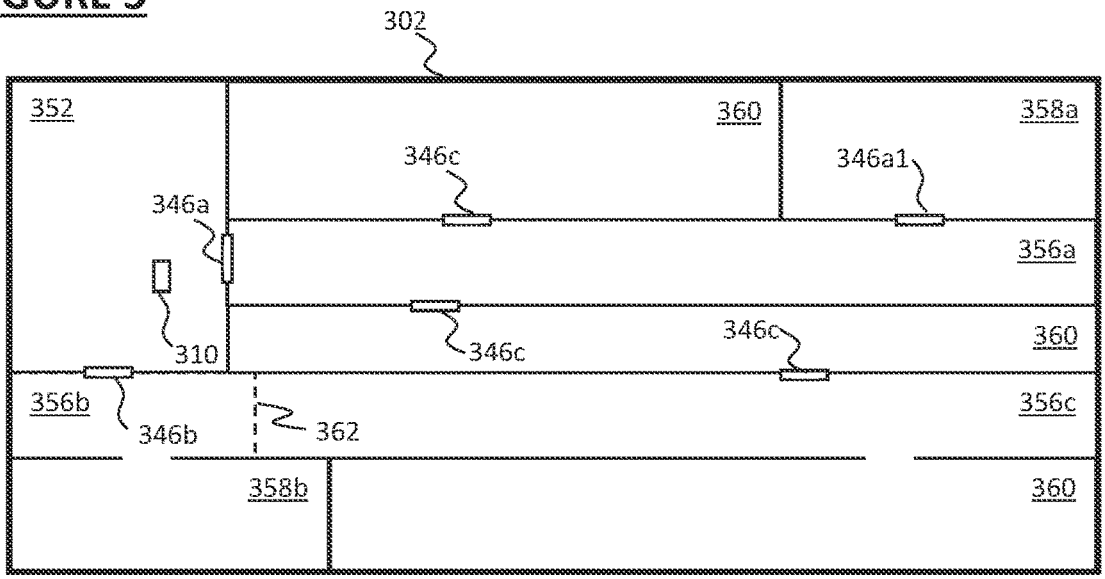
FIG. 3 depicts a schematic view of secure areas of a secure facility according to embodiments of the technology.

Accessibility may be limited to specific areas within a secure facility, with accessibility tailored to individual users. For example, as depicted in FIG. 3, a secure facility 302 may include a lobby 352 or other entrance space having one or more kiosks 310. A first user (such as a first vendor) requiring access to internal space 358*a* may be granted access to hallway 356*a* and internal space 358*a* by the system, which may unlock door 346*a* to grant the first user access to hallway 356*a*. The system may also unlock internal door 346*a*1 to grant access to internal space 358*a*. Note that the first user will not be granted access to other secure areas such as secure areas 360, 356*b*, 356*c*, 358*b*. Also, doors 346*c* will remain locked.

A second user (such as a second vendor) who needs access to internal space 358*b* may be granted access to hallway 356*b* and to internal space 358*b* by the system, and the system may unlock door 346*b* to grant the first user access to hallway 356*b* and to internal space 358*b*. Note that the second user will not be granted access to other secure areas such as secure areas 360, 356*a*, 356*c*, 358*a*. Also, doors 346*c* will remain locked.

Note that if a user wanders from an authorized area to an unauthorized area, an alarm may be provided, such as via an app on the user's smartphone. For example, if the second user wanders from approved/authorized hallway space 356*b* into non-approved/unauthorized hallway space 356*c*, an alarm may be activated. The alarm may initially involve a warning on the second user's smartphone (e.g., via the app) that warns the second user to return to the approved/authorized hallway area 356*b* (which may also include directions for the second user on how to return to the approved/authorized hallway area 356*b*.) Note that the hallway space 356*b* and hallway space 356*c* may be separated by a non-secured threshold 362, such as an unlocked door or open/unblocked threshold. Such an open threshold which may be indicated by a visible marker, or may be visible only to the system (such as where a tracking sensor is positioned at the threshold). The sensor may provide data to the system indicating that the second user has crossed the threshold. The tracking sensor may, for example, be a motion sensor or infrared sensor adapted to sense the movement and/or presence of a person, such as the second user. The sensor may be adapted to sense the presence of a smart phone, which may include the ability to sense the presence of a particular smart phone, such as where the app on the user's smart phone provides a signal from the smart phone. For example, the user's smart phone may (such as via the app) regularly transmit a signal (such as a Bluetooth signal) that can be detected by a sensor (such as a Bluetooth receiver). The system can use the signal received by the sensor to determine the position of the particular smart phone, and send warnings accordingly.

Such warnings could include warnings sent to the user via the smart phone (e.g., to activate audio or video warnings on the smart phone via the app), and/or warnings sent via speakers or video panels located in the area in which the smart phone is detected (e.g., an audio message via speaker warning the user to leave the secure area), and/or warning info sent to facility security (e.g., for further action by security personnel).

A user's smart phone may provide (e.g., via the system app and cellular transmission) tracking data indicating that the user has crossed the threshold into the non-approved area 356*c*. Such tracking data may include GPS location information or other information gathered by and/or specific to the particular smart phone.

Note that an alarm may also sound of a user stops movement for a significant period of time in an area where movement is expected, such as in a hallway space in which the user is authorized to traverse but not to linger for an extended period of time. The alarm may also sound if the user remains in any authorized space beyond a timeframe in which the user was authorized to be within that authorized space. Such movement stoppage or overstay may indicated unauthorized activity by the user or could indicate that the user has had an accident or medical emergency or otherwise requires assistance.

If the out-of-bounds, overdue, or non-moving user does not return to the designated route/space and/or leave the off-limit area and/or resume movement within a period of time after the initial alarm is provided to the user, the system can activate further alarm activity. For example, one or more facility alarms may be activated, such as notifying facility personnel (e.g., security personnel) and/or residents via computer and/or smart phone that an authorized user is in an unauthorized area and/or has stopped movement. Audio alarms can also be activated (e.g., sirens, voice announcements/ warnings, etc.), and/or visual alarms (flashing/strobe lights), which may be positioned at various locations within the secure facility. The system may shut (lock) facility gates/doors to isolate the user to prevent further out-of-bound wandering. The system may also activate specific cameras and/or sensors to provide data on the position of the user, as well as activating the app on the user's smart phone to provide data regarding the position and/or condition of the user. The system may activate the user's smart phone (via the app) to provide visual and/or audible alarms from the user's smart phone, which may enable searchers to more easily locate the user.

FIGS. 4A-4C depict a kiosk 410*a* according to embodiments. The kiosk 410*a* has a relatively large screen 412 for easy viewing by a user, including viewing by users who may be positioned some distance from the screen. For example, the kiosk may have a screen 412 having a diagonal dimension 414*a* (measured from opposing corners of the screen) of at least 12 inches. The kiosk 410*a* may preferably have a screen with a width greater than its height, such as a width which is at least 30 percent larger than the height. The screen 412 may preferably be a touchscreen permitting a user to interact therewith using his/her fingers. The screen 412 may preferably be high-impact resistant and/or scratch-resistant.

The kiosk 410 has a rugged, weatherproof enclosure 416 protecting the internal components thereof, such as an internal memory 418, internal processor 420, internal backup battery 422, etc. The enclosure 416 and screen 412 prevent the entry of water into the kiosk 410*a,* and also are hardened against impact such as from vandals, etc.

The kiosk 410*a* may have a camera 424, which may be a still camera, video camera, high-definition camera, etc. A camera 424 may have thermal imaging capabilities, which may be used to measure the temperature of a person using the kiosk 410*a* and/or to measure the temperature of other items in front of the camera. If a person using the kiosk is determined to have a fever, the kiosk 410*a* may issue a warning (visual and/or audio) to the person and/or the system may deny the person entrance to the facility. The system may admit a feverish person to specific areas (e.g., grant access to hallways leading directly to the user's apartment), but deny that specific person entrance to other particular portions of the facility, such as swimming pools, club houses, and other shared spaces.

The kiosk 410*a* may include a speaker(s) 426 and/or microphone 428 for communicating with a user. The kiosk 410*a* may also include a motion sensor 429 to indicate when a user is in front of the kiosk 410*a*.

The kiosk 410*a* may include a wired communication port 430, such as for communication via an ethernet/LAN connection. The kiosk may alternatively or additionally include wireless communication capabilities, such as cellular and/or Bluetooth transmitters and receivers 432.

The kiosk 410*a* may include one or more connection ports 434, which may be adapted to provide signals to and/or receive signals from one or more access points, such as lock activation/deactivation signals and/or access point sensor signals (e.g., signals indicating that the access point is open/closed/locked/unlocked). The kiosk 410*a* may also include a power input port 436 adapted to receive a power cord therein (not shown), through which the kiosk receives electrical power to drive the screen and other kiosk components.

Kiosks may include one or more sensors, such as thermometers, motion sensors 429, etc.

A system may include a combination of different kiosks 410*a,* 410*b,* including kiosks of different sizes, different mounts, and/or different capabilities/features. For example, a first kiosk 410*a* may be relatively large (i.e., 12 inches or larger in diagonal dimension) compared with kiosks of other/prior art systems, but with a second kiosk 410*b* (such as that depicted in FIG. 5) having an even larger diagonal dimension 414*b* (e.g., two or more; three or more; four or more; or even five or more times larger in diagonal dimension) than the diagonal dimension 414*a* of the first kiosk 410*a*. The system could have the second/larger kiosk 410*b* mounted in a lobby area, such as by being mounted on a wall or other structure (e.g., free-standing pedestal 440). The second/larger kiosk could control one or more doors or gates at or immediately adjacent the lobby area. The first/smaller kiosk could be mounted immediately adjacent a gate or door outside of the lobby area, with the first/smaller kiosk controlling that gate or door. The first/smaller kiosk could be adapted for mounting to a surface or post, such as to a wall adjacent the gate or door controlled by that kiosk.

It is noted that the larger and smaller kiosks may share some basic capabilities/features, such as touchscreens, user interaction, etc. In some embodiments, the larger and smaller kiosks have essentially the same basic capabilities, with the difference being the size of the kiosks (namely the difference in the screen size).

A kiosk 410*a*, 410*b* may be adapted to engage with a user's smart phone for system functionality. For example, the kiosk may have Bluetooth or other wireless capability to directly interact with a user's smart phone. The kiosk may be adapted to guide a user's smart phone in downloading a smart phone app for use with the system. For example, the kiosk may provide instructions by which a user can download the app to the user's smart phone. The app may provide the smart phone with various capabilities within the system (including capabilities of the kiosk), such as capabilities to download and display directions, ads, coupons, etc.; to access the facility through specific gates/doors; to interact with other users and/or facility personnel and/or outside parties (e.g., vendors, emergency personnel, etc.); to track the smart phone within the facility; etc.

Kiosks may preferably be adapted to facilitate the interaction of users (e.g., residents, visitors) with the system. When a user approaches the kiosk, the kiosk may be activated by the user touching the screen or upon the kiosk sensing (via motion sensor, camera, etc.) the presence of the user. The activated kiosk screen comes to life (e.g., lights up and begins interaction protocols) because the touchscreen is coded to react to specific touches on the screen and/or to movement adjacent the kiosk. The kiosk may be programmed to activate a different pre-recorded video of a real or virtual human-being based on the screen the computer is displaying with the system software. The guest or vendor may have the option to make a selection (e.g., touch a flag in the bottom left-hand corner) to change the real/virtual host and their language to make it as user-friendly as possible. As directed by the unique interactive digital host, the use may select the "Directory" then use their finger to find the desired resident profile to select. Once the desired resident is selected (e.g., through sorting by last or first name, or unit), the user will be given a choice of a "video call or a Digital Key". Selecting "video call" causes the kiosk and system to send a signal to the cloud server, which may communicate to a video chat provider (e.g., Twilio) to create a chat room. The chat room will call the number/access info of the resident (which will have been previously programmed into the resident's system profile when the administrator created it). The chat room will ring for up to 45 seconds and if answered the system will then bring the connection from the cloud back to the mobile app to show the resident who is calling them from the kiosk. The resident may have the following options: Answer, admit, and decline. Answering the call completes the video chat room where the users at both endpoints will view each other during the communication, and then the resident can admit the guest or let the time run out and not choose to admit them. If the resident admits the visitor (e.g., guest or vendor), then the app will send a signal to the cloud which will then return to the kiosk computer telling the kiosk which access point to open. The kiosk host will then alert the visitor that they've been admitted while also offering direction via a custom digital way-finding map.

If the resident admits the guest or vendor without creating the chat room by pressing the "+" in the center, then the app will again send a signal to the cloud which will then return to the kiosk computer telling it which access point to open. The kiosk host will then alert the guest they've been admitted while also offering direction via a custom digital way-finding map, after which the processor within the kiosk will trigger the relay to open the correct entry.

If the resident were to deny the call (e.g., not answer), then the app would tell the cloud to have the kiosk computer trigger the interactive digital host to alert the guest that the resident is not available and ask if the guest would like to leave a message (e.g., with a prompt to select "Yes or No" via the screen and/or audibly). If the guest says No to leaving a message, then the system will reset and may (e.g., after 30 seconds of idle time) revert to a kiosk "sleep" mode, such as by displaying a facility logo (e.g., a custom 3D digitally animated community logo). If the guest says Yes to leaving a message, then the system will give the guest time (e.g., 15 seconds) to leave a video and/or audio voicemail. At completion of the message, the kiosk computer will send the message to the cloud which will deliver it to the resident's smart phone app 812*a* with a notification of receipt. When the resident checks notification as described above, they will view the message and have the option to download it to their phone or delete it.

The kiosk may provide leasing information for prospective tenants (e.g., non-residents) who may be interested in leasing a unit at the complex (and also for residents who may be interested in leasing another unit at the complex). In an embodiment, the leasing information may be provided from a in publicly-accessible and/or publicly-viewable areas of the facility. The kiosk may include a selection for leasing inquiries, such as a selection for "complex amenities" and/or "available units." A selection of "complex amenities" may include listing of amenities (e.g., swimming pool, gym, etc.) and/or images of the complex, etc. Non-residents (and residents) can express interest in units, including providing their contact information (e.g., name, address, email, cell phone number, etc.) and even personal information (e.g., age, sex, annual income, etc.). Interest can be expressed in particular current or upcoming vacancies. Interest can be expressed as general interest in types of units, e.g., interest in units with specified numbers (or ranges of numbers) of bedrooms and/or bathrooms; interest in units with specific features (fireplace, dishwasher, air conditioning, balcony, specific views, covered parking, numbers of parking spaces, pet-friendly, etc.); interest in ranges of square footage; interest in units with ranges of leasing prices; interest in units with specific move-in dates (or ranges thereof); etc. If no available (or soon-to-be-available) units match (either completely or closely) the requested type of unit, the interested non-resident's (or resident's) info can be stored, and the non-resident (or resident) can later be contacted (e.g., via email, text, etc.) when any matching units become available or are indicated as soon-to-be available.

A selection of "available units" may provide a listing of units currently available, and/or units which may become available within the next week, 2 weeks, month, etc. The kiosk may provide information on the available units, such as rental rate, lease term, square footage, number of bedrooms and/or bathrooms, photos of the unit, floorplan of the unit, 3D models of the unit, amenities/features (e.g., (fireplace, dishwasher, air conditioning, balcony, specific views, covered parking, numbers of parking spaces, pet-friendly, etc.). The kiosk may be adapted to permit a user to express interest in the complex and/or in one or more units (specific units and/or general units (e.g., "2-bedroom units"), such as by entering contact and/or other information of the user (e.g., name, phone number, physical address, and/or email address). The kiosk may also be adapted to permit an interested user to download (e.g., via the internet or directly from the kiosk, such as via Bluetooth) a guest app with which the user can access information (e.g., updates) about units and/or the complex.

Where a complex is one of several complexes which are commonly owned/managed and/or wish to share information (such as contact information of interested users), the kiosk may provide information about other complexes and their respective available (or soon-to-be-available) units.

The leasing information may be provided from the kiosk as described above, and/or may be provided via a resident and/or user app. The system may provide the ability for a resident or guest to refer vacancies to 3$^{rd}$ parties, and may provide a referral reward to the referring resident or guest if the 3$^{rd}$ party leases a unit. The kiosk may be the point of check-in for the prospect "non-resident" for their tour with or without a leasing officer (such as for a self-guided tour for which the user accesses the facility using a one-time access key provided to the user by the system). The system may record the entry of the one-time key with the time-stamped photo as well as provide a map (such as a a custom digital way-finding map) to the unit of interest or to the leasing office. The map may be provided via the kiosk and/or via a guest user app provided to the prospective tenant via the prospective tenant's smartphone or other portable electronic device. The map(s) may be controlled and/or stored and/or generated via the remote host server, e.g., the map may be stored in a database co-located with the host server and/or under the direct control of the host server (such as a cloud-based database controlled by the host). Alternatively, the map(s) may be in a database hosted by and/or co-located with a separate map server (such as a map server controlled by a party other than the remote host server). That separate map host may be separately controlled from the main host server (e.g., via a dedicated map database server), and accessed by the access control system via a data transfer connection (e.g., an API connection). For example, the map database server may be controlled directly by the facility management company, which may control the information contained in the map database. The map database server may be controlled by a 3$^{rd}$ party that hosts and updates databases on multiple maps for multiple facilities.

To operate the Digital Leasing Office function, a guest or a vendor (e.g., real estate agent) approaches the kiosk. To activate the kiosk, they touch the screen and it comes to life because the touchscreen is coded to react to specific touches on the screen. A different area may be programmed to activate a different pre-recorded video of a real human-being based on the screen the computer is displaying with the system software. The guest or vendor will have the option to select (e.g., by touching a flag or other indicator on the screen) to change the host and/or the language to make the kiosk interaction as user-friendly as possible. As directed (if applicable to the guests needs) by the unique interactive digital host, the user (e.g., guest/non-resident or other user) can select the "Vacancies", which will cause a display of vacancies to appear, such as via a list and/or icons of units. The listing and/or icons (e.g., a photo of the unit) may include some information about the unit (e.g., rental rate, numbers of beds/baths, model type, available date, etc.). The user can then select (e.g., via touch-screen interaction using a finger, etc.) from displayed units which are available (or soon-to-be-available) within the building. Each of the displayed units may be selected for more specific details of that specific unit. If the prospect likes the details of any chosen unit, the digital interactive host guides the user all the way through the process of applying for the unit, including expressing interest in the unit, providing contact info of the user, scheduling a showing of the unit, etc. When the prospect submits the lead by completing the requested fields (at least some of which may be required) using the digital keyboard of the kiosk, the kiosk computer sends the info on the requested fields to the cloud/internet, where the server sends the inquiry information (e.g., unit(s) of interest, prospect contact info, scheduled showing date, etc.) to the assigned email or administrative backend corresponding to the assigned kiosk.

The system can provide directions, such as a map, to a user (e.g., visitor, vendor, etc.) via a kiosk and/or smart phone app, with the directions including on-screen mapping, on-screen text, and/or audio for a user. The directions can be generated by a processor using facility information (e.g., facility mapping data) held in a memory, and also using information specific to the user (e.g., the user's purpose and/or destination within the secure facility). The directions may provide a direct route to the appropriate location for the user (e.g., guest) so there is less confusion. For example, for quicker deliveries, etc., a map of the best route to the unit desired shows up on the kiosk after a visitor or vendor etc. is admitted by the resident. This map may also show in the guest app on a guest user's smartphone. Note that the map data and/or actual map may be provided from a database under the direct control of the host server, or may be provided from a database under the control of the facility management itself, or may be provided from a database under the control of a 3$^{rd}$ party (such as a 3$^{rd}$ party that develops and/or collects and/or maintains and/or updates maps which are provided by that 3$^{rd}$ party map server). Where the map database is under the control of a separate server (e.g., facility server or 3$^{rd}$ party server), the map database is accessed (e.g., by the resident app or guest app) using a communication link such as an API connection.

A map may include a depiction of the desired route, and may be displayed on the kiosk screen. Alternatively or additionally, the onsite map may be provided on the user's smartphone via the user's app (e.g., guest app or resident app). The on-site mapping may, such as via the app, interact with location-indicating capabilities of the smartphone (such as the smartphone's GPS) to provide real-time location of the user. The real-time location information may be used with the app on the smartphone to provide an onsite map which depicts, in real-time, the location of the user along the desired route. If the user strays from the desired route, the app may provide a warning to the user, such as via sound (e.g., alarm bell), vibration, visual (e.g., flashing screen) to indicate that the user has strayed from the desired route. The app may provide an updated route to get the user back onto the desired route, or to another (e.g., updated) route that accounts for new ("off-route") position of the user. The app may include a "where-am-I-now" feature, such as an on-screen selection link, which permits the user to inquire as to his/her current location and to receive an update thereof. The app may also include an option for a user to change his/her destination, such as an on-screen selection link for "change destination" with a selection of options, such as "return to exit" or "go to management office", etc.

Figure 6A:
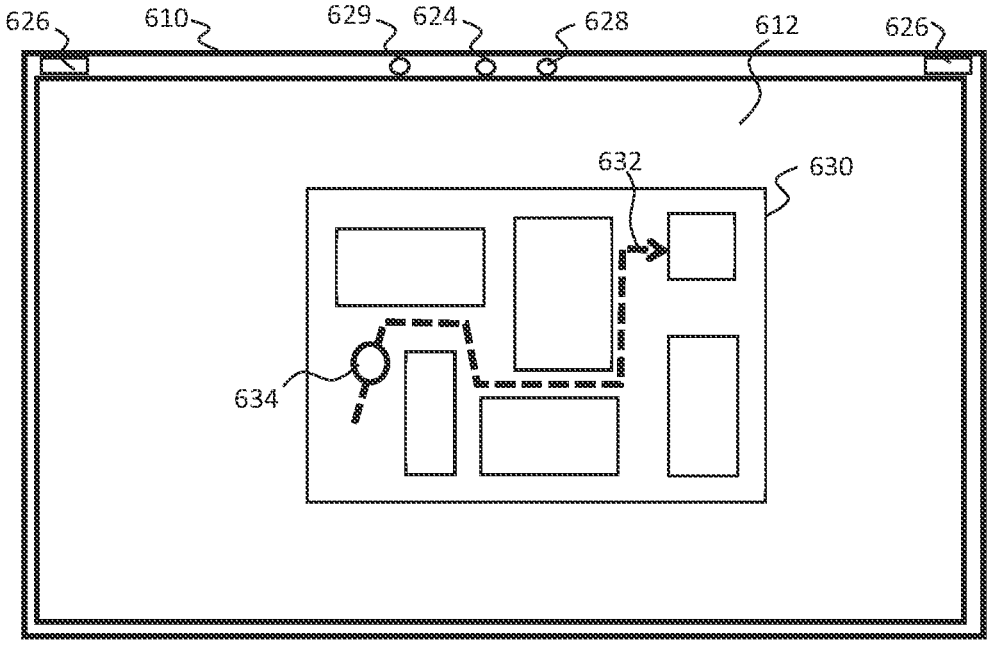
FIG. 6A depicts a front view of a kiosk screen showing directions according to an embodiment of the technology.

As depicted in FIG. 6A, the directions can be provided via a kiosk 610 (e.g., on-screen mapping, on-screen text, and/or audio) to a user (such as a visitor or vendor) that the user can follow to arrive at a desired destination within the secure facility. The directions can be user-specific, and be based on the destination to which the user is authorized to go within the secure facility. The directions may include a display of a facility map 630, with the specified route 632 indicated thereon. The location of the user 634 can also be included in the display.

Figure 6B:
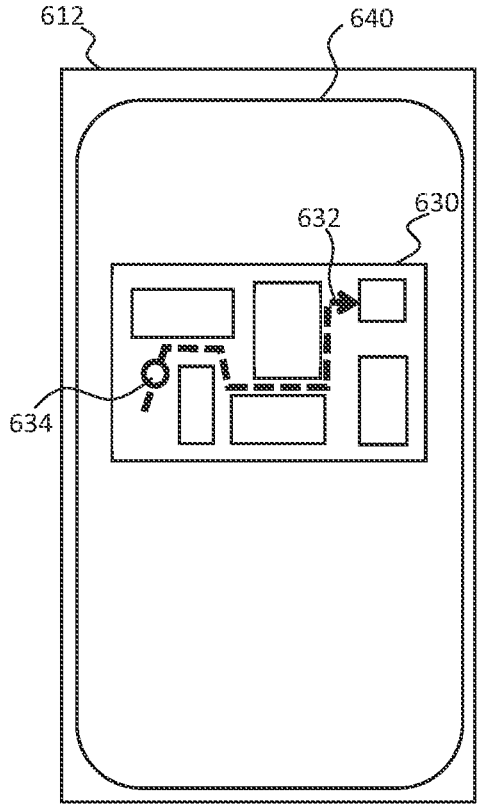
FIG. 6B depicts a front view of a smart phone showing directions according to an embodiment of the technology.

Note that, as depicted in FIG. 6B, the directions can alternatively or additionally be provided to the user's smart phone 612, such as via the smart phone app of the system, so that the user can have the directions with him/her (e.g., on the smart phone screen 640) while following the desired route. Such directions may include on-screen mapping showing the desired route 632 and/or the position 634 of the smart phone 612 (and hence of the user) within the secure facility and/or along the desired route. The smart phone app may provide tracking capability, such as using known cell phone tracking protocols (e.g., GPS, multilateration of cell phone signals, etc.), to track the location of the smart phone within the secure facility, with the smart phone location data used by the system (e.g., with the smart phone app) to add the smart phone position to the on-screen mapping of the smart phone. Note that the tracking capabilities of the app may be disabled automatically once the smart phone is determined to have left the secure facility.

The app can provide a warning signal if the smart phone 612 (and hence the user) strays from the desired route. Such a warning may initially warn the user, such as via visual or audio instruction from the smart phone 612, to return to the approved/authorized route. Note that an initial alarm may also sound of the user stops movement for a significant period of time in an area where movement is expected, such as in a hallway space in which the user is authorized to traverse but not to linger for an extended period of time. The alarm may also sound if the user remains in any authorized space beyond a timeframe in which the user was authorized to be within that authorized space. Such movement stoppage or overstay may indicated unauthorized activity by the user or could indicate that the user has had an accident or medical emergency or otherwise requires assistance.

If the out-of-bounds, overdue, or non-moving user does not return to the designated route/space and/or leave the off-limit area and/or resume movement within a period of time after the initial alarm is provided to the user, the smart phone 612 (via the app) can provide info to the system to activate further alarm activity. For example, one or more facility alarms may be activated, such as notifying facility personnel (e.g., security personnel) and/or residents via computer and/or smart phone that an authorized user is in an unauthorized area and/or has stopped movement. Audio alarms can also be activated (e.g., sirens, voice announcements/warnings, etc.), and/or visual alarms (flashing/strobe lights), which may be positioned at various locations within the secure facility. The system may shut (lock) facility gates/doors to isolate the user to prevent further out-of-bound wandering. The system may also activate cameras and/or sensors to provide data on the position of the user, as well as activating the app on the user's smart phone to provide data regarding the position and/or condition of the user. The user's smart phone 612 (via the app) may provide visual and/or audible alarms from the user's smart phone, which may enable searchers to more easily locate the user.

Figure 7A:
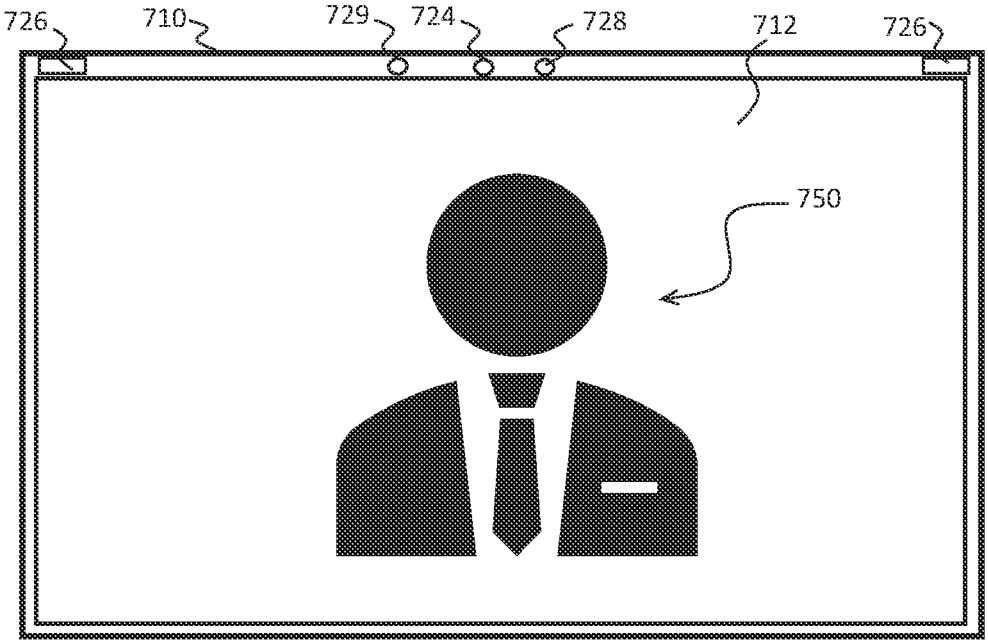
FIG. 7A depicts a front view of a kiosk screen showing a virtual host according to an embodiment of the technology.

As depicted in FIG. 7A, a kiosk 710 may provide a virtual concierge/host image 750 on the screen 712. The virtual concierge/host 750 may be computer-generated imagery in the form of an avatar depicting what appears to be an actual person, including movements and voice. The virtual concierge/host 750 may interact with the user in a life-like manner, and may respond to feedback from the user (such as oral statements by the user which may be picked up by a microphone on the kiosk, touchscreen inputs from the user, movement of the user as indicated by motion sensors on the kiosk, etc.). The virtual concierge/host 750 may interact verbally with the user via kiosk speakers 726 and microphone 728, and/or may interact visually with the user via the screen 712 and/or kiosk camera 724, and/or may interact via touchscreen selections offered by the kiosk 710 and accessed (via touch on the screen 712) by the user, etc.

The virtual concierge/host 750 may be generated using memory data, sensor input, and/or processor functions, creating live-action images of the avatar. The electronics (memory processor, sensors) and/or algorithms for generating the virtual concierge/host 750 may be resident in the kiosk, and/or may be resident with the remote host server. For example, data on the specific characteristics of the virtual concierge/host (e.g., hair color, facial characteristics, language, etc.) may be generated/stored by the remote host (which may store such virtual concierge/host data in a host database). The virtual concierge/host data for such characteristics can be transmitted to the kiosk. The kiosk's internal electronics/algorithms may then take that virtual concierge data and generate the image of the virtual concierge/host, with the kiosk's internal electronics/algorithms providing the live-action movement of the virtual concierge/host 750.

The data for such virtual concierges/hosts may be stored within the host server database and/or in the kiosk database and/or in the facility administrator database and/or in the user's portably electronic device (e.g., smart phone or smart watch). Storage locally, such as in the facility administrator database or in the kiosk database, may provide more rapid generation of the on-screen virtual concierge/host when the resident uses the kiosk, especially where there might be communication slowdowns or cutoffs between system components (e.g., between the kiosk and the host server, between the kiosk and the facility administrator, between the host server and the facility administrator, etc.). The host server database may include data on a very large selection of virtual concierges/hosts, while the local facility or kiosk may only store a smaller selection (e.g., only store data for the virtual concierges/hosts that have been selected by residents of the facility at which the particular kiosk is located). The system may preferably provide the same virtual concierge for a particular user across all platforms, such as kiosks, smart phones, smart watches, automobile display screens, etc. In other words, a particular user his or her particular virtual concierge on the local kiosk when using that kiosk, and will also see that same particular virtual concierge on his or her personal electronic device (e.g., smart phone and/or smart watch) when using the smart phone app, and on a personal computer when accessing the system via a system portal, etc. The particular virtual concierge assigned to or selected by the user thus becomes a "familiar face" for that user.

A virtual concierge/host may have particular concierge/host characteristics, such as hair color, eye color, skin color, race, ethnicity, sex, age range, language, accent, clothing, eyeglasses (such as sunglasses), etc. The system may have (or be capable of generating) multiple virtual concierges/hosts, with each virtual concierge/host having different concierge/host characteristics, such as language, hair color, hair style, skin color, sex, voice characteristics/tone, voice accent, etc.

A user (e.g., resident) may select or program a desired virtual host from a list of available hosts and/or list of host characteristics. The kiosk could initially assign a virtual concierge/host to a user, with the initial assignment being random or being based on other factors, such as on known user characteristics of the particular user or on known characteristics of other residents of the complex. For example, the system could select the particular virtual concierge/host for a user based on the known or apparent (e.g., system-assessed) characteristics of the user, such as sex, age, language, voice characteristics, voice accent, etc., which could be collected by the kiosk using the kiosk camera and/or kiosk microphone or other system sensors.

The system could select the virtual concierge/host based on the appearance and/or sound of a user, which could be performed in cooperation with a camera and/or microphone interacting with facial and/or recognition and/or other operations. For example, the system could use facial recognition capabilities to visually identify the appearance and/or skin color and/or sex and/or approximate age of an individual. Alternatively or additionally, the system could orally identify the voice and/or sex and/or approximate age and/or preferred language and/or accent and/or other characteristics of an individual. The system could generate a virtual concierge that closely matches or otherwise parallels the appearance and/or sound of the user. The camera and/or microphone for such determination could be positioned in or on the kiosk, and/or in or on a user smartphone hosting the app.

The system could modify a selected virtual concierge/host based on holidays and/or seasons and/or time of day, such as by adding costume elements to the virtual concierge/host. The user could select such costume elements for his/her virtual host, which could be selected in response to prompts from the system (e.g., via the kiosk and/or the smartphone app).

Note that the selection of virtual host (including host characteristics) may be performed by a process hosted within the kiosk itself, and/or within the hosting system, and/or within the user smartphone app (resident or guest), etc. The user (e.g., resident or guest) may select a preferred host (including specific characteristics of the virtual host) via the kiosk and/or via the user app on the user's smartphone.

Figure 7B:
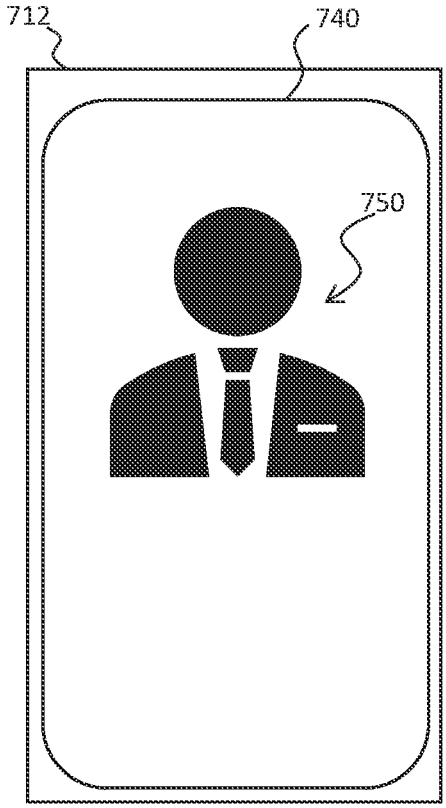
FIG. 7B depicts a front view of a smart phone showing a virtual host according to an embodiment of the technology.

Note that a virtual host 750 could be presented on the screen 740 of a user's smart phone 712, as depicted in FIG. 7B, which could be in addition to or in lieu of corresponding presentation on the kiosk 710. The virtual host 750 could be generated using the smart phone app, which may include use of the memory and processor within the smart phone 712. The virtual host data may be provided to the smart phone by the host server, and/or may be input by the user into the smart phone via the app and held within the memory of the smart phone and/or in cloud backup memory and/or with the host server. The same or similar virtual host could be presented on the smart phone 712 as on the kiosk 710. Alternatively, the virtual host could be significantly different between smart phone 712 and kiosk 710.

Figure 8:
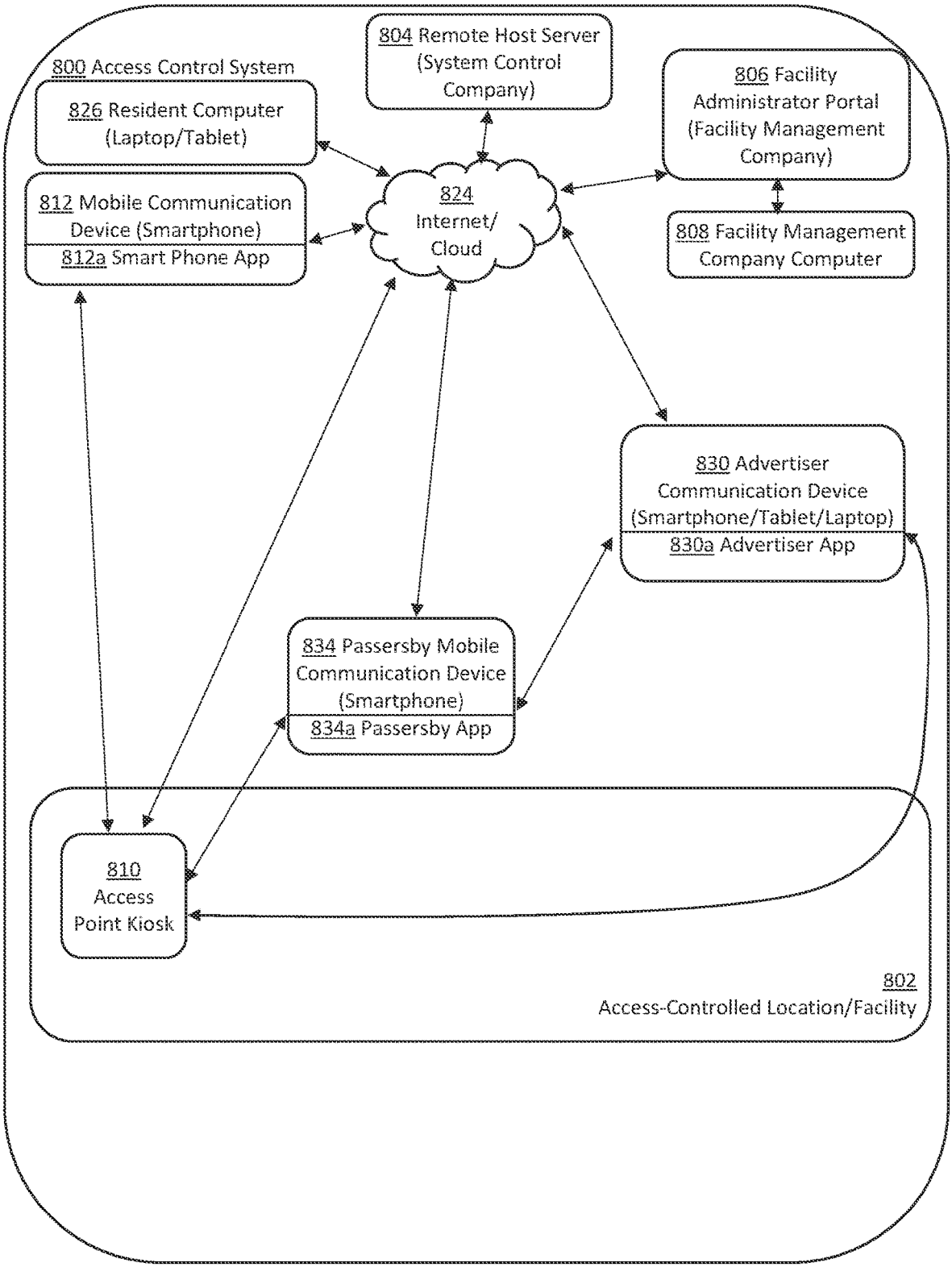
FIG. 8 depicts a schematic view of a system according to embodiments of the technology.

Systems according to the technology may be adapted to provide advertising for local businesses, which may be include targeted advertising and/or coupons. For example, as depicted in FIG. 8, a system 800 for a secure facility 820 may include one or more access kiosks 810, with residents and other authorized users (e.g., visitors) using smart phones 812 or other electronic communication devices to access the facility, such as via an authorized user app 812*a*. Advertising may be provided via the access kiosks 810 and/or via the smart phones 812 (e.g., using smart phone apps).

Businesses, such as restaurants or other businesses located nearby to the secure facility 802, may wish to advertise to the residents, visitors, employees, vendors, and/or passersby of the secure facility 802. To initiate such advertisements, a business could contact the remote host server 804 and/or local facility management 808 via email, text, telephone, regular mail, etc. The business could make such contact via a business access portal, such as via a tablet or other communication device 830 (e.g., laptop, smart phone, etc.) of the business, which may include an app 830*a* that the business could download and with which the communication device 830 communicates with the remote host server 804.

The access kiosk 810 could provide the initial contact info for businesses that might want to advertise with the secure facility. For example, the kiosk 810 (especially a kiosk facing toward public areas such as toward local sidewalks, etc.) could display a screen inviting businesses to contact the host server and/or local facility for potential advertising of the businesses' products and/or services.

The business access portal may provide the advertising business with the ability to manage their advertisements/coupons. The is may include the ability for the businesses to create and manage advertising (e.g., coupon details), which may require the business to create a log in via a webpage and/or local app, such as an app on the smartphone of the advertising business (i.e., advertisement/coupon subscriber business). Businesses may pay for advertisements, such as coupon listings. Such payment may be based on actual coupon usage at the business and/or other actual purchases by user's (e.g., residents or guests) at the advertising business.

Advertisements (including coupons) may be displayed directly on the screen of the kiosk 810. The advertisements may be held in local memory of the kiosk 810, and selected randomly or based on time (e.g., presented at specific intervals and/or at times of day). The advertisements may be targeted, such as being activated for screen presentation on the kiosk 810 based on the proximity of a specific smart phone or type of user. For example, on detecting that a smart phone adjacent the kiosk belongs to a resident, the kiosk may select and display one or more advertisements for products/services of particular interest to residents, such as advertisements for insurance, mechanics, etc. If a kiosk-adjacent smart phone is determined to belong to a visitor, the kiosk 810 may select and display advertisements for products/services of particular interest to visitors, such as advertisements for local tourist attractions. If a kiosk-adjacent smart phone is detected and determined to belong to a person of a certain age or range of ages, the kiosk may select and display advertisements for products/services which may be of particular interest to persons of that age/range. Characteristics of users which may be used to prompt specific advertisements to be displayed include age, sex, residency (e.g., visitor vs. resident), history at facility (new resident vs. long-term resident), etc.

Note that the age, sex, and other characteristics of a user may be detected by the kiosk 810, such as by using sensors (e.g., cameras, microphones) in or adjacent the kiosk. Once the kiosk 810 determines that a user with specific characteristics is at or adjacent or approaching the kiosk 810, the kiosk 810 can provide advertisements targeted for the specific age, sex, etc., of the user.

For targeted advertising, the system may use its own capabilities to determine which advertisements may be of particular interest to particular users. For example, the host server may compare its database of residents and their characteristics (including age, sex, interests, etc.), and use that comparison to select the advertisements seen by particular users. For example, the system may provide specific advertisements to new residents, or to residents of a certain age/range, or to residents with specific interests.

The system may provide the business (such as via the advertiser communication device 830/app 830*a*) with the option to identify the types of persons to which the business wants advertisement(s) shown. For example, a beauty salon could request that its advertisements be presented to all women users, or to women users who are residents of the facility (as opposed to just being visitors), or to women users who are residents but have recently moved into the facility, etc.

Note that the system may select advertisements presented to particular users based on a combination of business-identified "target" users as well as the system's own user-targeting abilities. The system could thus provide advertising to users outside of the particular area targeted by the business, potentially enlarging the business customer base.

Advertisements presented on the kiosk 810 may be provided in relatively large format and with moving images, and directed (via an outward-facing kiosk) to be seen from adjacent areas, including adjacent public areas such as public sidewalks, roads, etc. Such large format and moving image advertisements are adapted to draw passersby to view the kiosk 810, even where the kiosk itself is located on Advertisements may be presented on user's smart phones, such as a smart phone 812 (with app 812*a*) which is in communication with the host server 804. Such advertisements may be transmitted to the smart phone 812/app 812*a* from the host server 804 and/or from the facility administrator 806. Note that advertisements may also be provided to a user's smart phone 812 directly from a kiosk 810, such as through wireless transmission (e.g., Bluetooth) or visually (e.g., via bar code image on kiosk 810 as discussed below).

Advertisements presented on a kiosk screen or smart phone screen may include screen images of specific business information, including products (e.g., menus), services, prices, hours of operation, physical address, web page address, contact info (e.g., phone/email), etc. Advertisements may also include coupons which a user (e.g., resident, visitor, passerby, etc.) may use at the business. Advertisements may include readable bar codes (e.g., QR code) or similar machine-readable images which can activate a camera-equipped smart phone or tablet to access, via established cell/internet protocols, further information about the business (including information about coupons).

Such readable bar codes if provided on the kiosk screen may be accessed by a user using the user's smart phone camera (e.g., resident/visitor customer smart phone 812/app 812*a* and/or passersby smart phone 834/app 834*a*), such as by the user taking a photo of the bar code as displayed on the kiosk screen. For example, a user could take an image of a kiosk-displayed coupon code using the user's smart phone camera, and present such coupon code (e.g., as an image) to the business. The user could take an image of the kiosk-displayed coupon code using smart phone camera, which could activate the smart phone (e.g., via the app or other protocols) to access a website or other portal with further coupon and/or business details (e.g., menu, etc.) and/or additional codes or coupons. The user can then go to business or go to the business's website, and present the kiosk code and/or additional codes or coupons to the business for the respective discount.

When a user with coupon or other system-generated business code is at the business, the business may enter the customer-provided code or additional code/coupon information into a business communication device (smart phone, tablet, other computer), which transmits the customer-provided code/info to the host server via cloud/internet/cell. The host server may track usage of customer-provided codes/coupons/other codes used at that business, including which users presented each customer-provided code. The host server can use such data to provide award points to users, and/or to determine payment due from a business, and/or to generate customer demographic data (which can be provided to the business). The payment from a business for advertising via the system could be determined as a function of the amount of kiosk codes/coupons/other codes actually used at that business, as tracked by the host server and/or business app.

In an example of coupon usage using a user's own smart phone or other personal communication device, a user (e.g., resident or guest) opens the app 812*a* on their smart phone/personal communication device 812, then chooses "coupons" from the menu. The personal communication device 812 (via the ap 812*a*) may display different categories for the types of resident-specific and/or guest-specific coupons, such as: Automotive, Dry-Cleaning, Food and Drink, Health and Wellness, Pet Care, Salons and Spas, etc. The coupons may have blackout times/dates, or may be uniquely be "anytime" use coupons which do not hold restrictions due to blackouts. When a category is selected by the user (such as by selecting via the smart phone touchscreen), the list of participating business (vendors) within the category may appear. The list itself may include further details of each vendor, and/or further details may be provided when a user selects a particular vendor from the list. Details may include the vendor's location, phone number, website services/products, prices, menus, etc. The list or post-vendor-selection screen may also provide the user with an offer to gain the user's (resident's or guest's) business, such as via a coupon offered on the smart phone 812 via the app 812*a*. The user may choose the coupon on the app 812*a*, then present the phone to the vendor (such as via in-person interaction at the vendor and/or entering the vendor-tracking coupon number or other info online) in order to validate the coupon. The app will then send a message to the cloud server which will communicate to the host server and/or the local facility management system that a particular vendor's coupon was used. The host server and/or the local facility management system may award the one or more awards, such as LPs (Loyalty Points), to the resident or other user. The awards (e.g., LPs) may be used to submit for rewards to the resident/user through a loyalty program.

The system may use one or more outside servers 840, such as a 3$^{rd}$ party map server that hosts and provides map information (e.g., to the resident app and/or guest app and/or vendor app). Such outside servers may be accessed via other system elements (e.g., the server host, the facility management computer, smart phone apps (vendor, resident, passersby, guest, prospective resident, staff, etc.) via communication links such as API connections, etc. The outside servers may provide information regarding maps, advertisements, etc. Note that different apps may have access to different information from the host server and/or outside servers. For example, a guest may be granted access to limited map information, a resident may be granted access to additional map information, and staff may be granted access to all map information.

The system may include an access portal for businesses to enter and manage their ads/coupons. The access portal may be accessed via known internet protocols, such as via a web page and/or local app, such as an app on the business subscriber's smart phone. Businesses may pay for advertisements, including coupon listings. Such payment may be based on actual coupon usage at the business.

When the kiosk is not in use, it may revert to a "sleep" or non-use phase, which may include the screen going blank, etc. The non-use or "sleep" screen may include an active screen which may include displays configured to draw the attention of passersby and to entice such passersby to approach and interact with the screen, such as via touchscreen interactions, etc. These may include "eye-catching" displays designed to draw a viewer's attention, such as flashing and/or animated and/or "3D"-appearing displays. For example, so-called "3D animations" may be used, which make use of known graphical software which use a 2-dimensional screen to give the appearance of a 3D image being rotated. For example, 3D animations (such as where a 2-dimensional screen is used to depict objects being at least partially rotated in order to give an appearance of 3-dimensionality) could be used. The attention-drawing display may include business logos, such as a logo of the particular community/complex at which the kiosk is located. The attention-drawing display may include logos and other ads for businesses (such as local restaurants, local dry cleaners, etc.), and may include touchscreen selections for more information on that business, such as an option to select information about the community/complex (such as unit availability, etc.), an option to select coupons that can be used at that business, an option to select menus of a local restaurant, an option for a map showing a route to that local business, etc.

The system may keep track of the interactions from passersby, with such interaction information used to monitor the number of "hits" from passersby for a particular ad and/or business, etc. This interaction information may include the date and time of day each hit as well as the particular interactions of the hit, such as the business information sought by the passerby (where that passerby interacted with the touchscreen for more information on that business). The interaction information may be provided to the particular business to enable the business to refine its advertising and/or product offerings.

Figure 9:
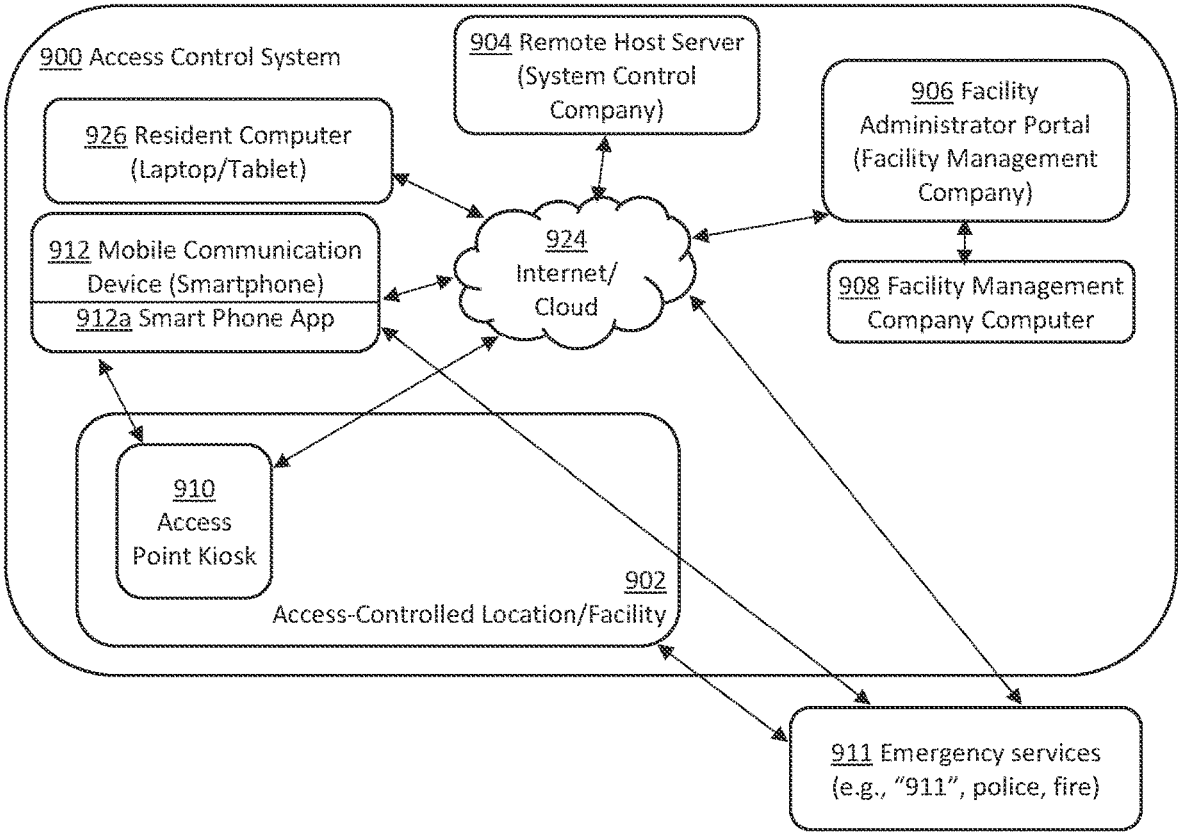
FIG. 9 depicts a schematic view of a system with emergency components according to embodiments of the technology.

FIG. 9 depicts examples of system components adapted to interact with emergency/security systems, such as local "911" emergency systems 911. The exemplary system 900 provides for interaction with emergency services 911 via kiosks 910, smartphones 912 (e.g., via apps 912*a*), resident computer 926, facility management portal 906, and/or the host server 904. The interactions may be conducted via internet connections (e.g., cloud), cell phone connection, traditional phone lines, etc.

A kiosk may have the ability for users (including passersby) to use the kiosk 910 to place emergency calls, such as to call "911" and/or facility security from the kiosk. For example, the kiosk 910 may have a touchscreen option for "emergency" (e.g., "911"), which when activated by a user will call "911" emergency services 911 and/or facility security from the kiosk and put the user in contact with the local emergency services 911 dispatch and/or facility security. The kiosk 910 (including microphone, speaker, screen, and/or camera) can be used by the user to communicate with the emergency services 911 and/or facility security personnel. For example, upon the kiosk being used to call emergency services 911 and/or facility security, the system 900 (e.g., via the kiosk 910) may grant access to the emergency services 911 (e.g., dispatch) to view video feed from the kiosk camera and microphone and speakers, and may also grant access to adjacent system cameras and microphones and speakers at the particular facility 902. The emergency services 911 may also be granted access to other system components, such as door access, user tracking (via smartphone app, etc.), facility maps, etc.

Upon the kiosk 910 being activated (e.g., when a user engages with the kiosk, and/or when a user dials "911" from the kiosk 910, and/or when a user approaches the kiosk 910), the kiosk 910 may start recording using its camera(s) and microphone. The kiosk 910 (and/or other system elements, e.g., host server 904) may also initiate other elements (e.g., system cameras and/or microphones adjacent the kiosk 910 and/or elsewhere at the particular facility 902) to record and/or transmit images (e.g., pictures, video) and/or sound.

Kiosk emergency operations (e.g., recording, 911 access, etc.) could be automatically activated by sounds of a car crash, gunshot, scream, alarm, siren, etc., and/or automatically activated by visual elements (e.g., flashing emergency lights, etc.). Kiosk emergency operation could include informing personnel of the facility 902 (e.g., facility security personnel) of the emergency activation, and providing to the facility personnel real-time video and/or audio from kiosk 91 and/or from other cameras and microphones at the facility.

The kiosk 910 may provide emergency access to emergency personnel. For example, local emergency personnel may be provided with a specific access code that, when entered at the kiosk 910, can unlock and/or open gates/doors, and may also display maps to desired locations within the facility (e.g., locations of fire extinguishers, elevators, stairwells, etc.)

A smartphone app 912*a* of the system 900 could be configured to allow a user (e.g., resident, guest, staff, etc.) to call emergency services 911 from the smartphone 912, and to use the app to grant access to emergency personnel to the system components such as facility cameras, speakers, microphones, gate/door locks, directions within the facility 902, etc.

The facility management portal 906 may be configured to call emergency services 911 via direct telephone connection, cloud, etc. The facility management portal 906 could be used to "call" users within an "emergency" area, and allow the users to interact with the system 900 via their smartphones 912 and/or computers 926 (e.g., laptops/tablets) (e.g., via the app 912*a*), and/or via kiosks 910. Such calls could include contacting residents and/or guests and/or staff and/or vendors who are or might be within the facility 902 (or within a specific part of the facility) of potential issues, such as security risks (e.g., fire). The facility management portal 906 may be configured to selectively grant emergency personnel access to the facility 902 via gates, etc., and/or access to system elements such as images from facility cameras, sounds from facility microphones, facility maps, etc. For example, facility personnel could request and/or provide, via the facility management portal 906, digital access codes to the emergency personnel that would enable the emergency personnel to access the facility 902 via one or more access points (e.g., gates or doors).

The host server 904 may be configured to call emergency services 911 via direct telephone connection, cloud, etc. The host server 904 may be configured to "call" specific users within an "emergency" area, and allow those specific users to interact with the system via their smartphones 912 and/or computers 926 (e.g., laptops/tablets) (e.g., via an app 912*a*), and/or via kiosks 910. Such calls could include contacting residents and/or guests and/or staff and/or vendors who are or might be within the facility 902 (or within a specific part of the facility) of potential issues, such as security risks (e.g., fire). The host server 904 may be configured to grant emergency personnel access to the facility 902 via gates, etc., and/or access to system elements such as images from facility cameras, sounds from facility microphones, facility maps, etc. For example, the host server 904 could provide digital access codes to the emergency personnel that would enable the emergency personnel to access the facility 902 via one or more access points (e.g., gates or doors).

Figure 10:
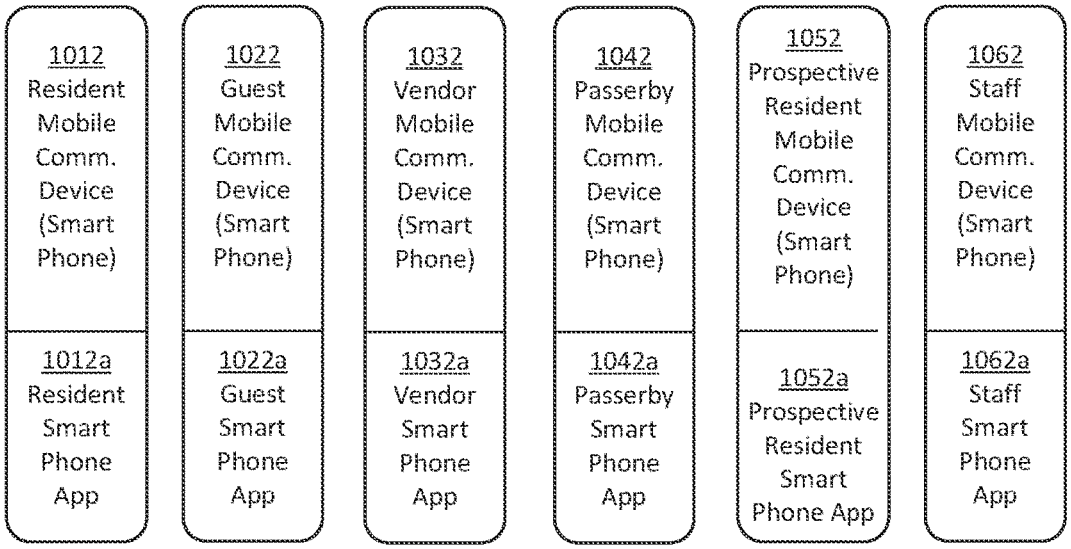
FIG. 10 depicts a schematic of different apps according to embodiments of the technology.

As shown in FIG. 10, system and devices according to embodiments of the technology may comprise different apps 1012, 1022, 1032, 1042, 1052, 1062 for download to the portable electronic devices (e.g., smart phones) 1012*a*, 1022*a*, 1032*a*, 1042*a*, 1052*a*, 1062*a* of residents, guests, vendors, staff, public/passersby, etc., to download to their smartphones or other personal communication devices. Different apps may be provided to different type of users, with the different apps having different features/capabilities. The apps are provided by the host server to users' portable electronic devices (e.g., smart phones), and may be stored in memory therein. Internal processors of the portable electronic devices run the apps.

Residents may be provided (e.g., via the host server and cloud) with a resident app 1012*a* for download to the resident's portable electronic device (e.g., smart phone) 1012 that interacts with the system to provide access to digital keys for the facility, maps of the facility, ads/coupons for businesses, rent payment options, maintenance requests/updates, resident announcements, media/entertainment, health & wellness, community engagement, bulletin board, renter's insurance, video/audio link to kiosk, remote opening of access points (e.g., gates and doors), etc. A resident app may have enhanced privileges compared to other apps, such as the ability to activate/deactivate location tracking of the user's smart phone, and/or the ability to track the location of other users' smart phones (e.g., smart phones of guests or children of the resident). For example, a resident app may provide a resident (such as a parent) the option to track the location of another smart phone within the facility, such as the smart phone of the user's child or guest(s) or vendors, with such tracking via the app in the child's or guest's or vendor's smart phone.

Guests may be provided (e.g., via the host server and cloud) with a guest app 1022*a* for download to the guest's portable electronic device (e.g., smart phone) 1022 that may have all the features of a resident user app, or may have some limitations and/or additional features. For example, the guest app may give guests easy access to digital keys for the facility, maps/directions of the facility, ads/coupons, etc. Accessibility for the guest (e.g., the ability to open specific doors/gates, dates and times of access to facility areas, etc.) may be subject to approval by the resident they are visiting and/or the management company. For example, a resident may use the resident's smart phone app to provide (via the resident smart phone and the host server) a guest's smart phone app with specific access capabilities, such as granting access to specific areas on specific dates/times. The guest app may keep track of a guest's location and provide location data to the host server, and may provide location data as well as updates (e.g., via the host server) as to when the guest arrives and departs the facility. The guest location data and updates can be provided by the host server to facility management and/or the resident whom is hosting the particular guest. The guest app can also provide info to the host system and/or facility management and/or hosting resident if a Guest overstays from the anticipated duration of visit, by tracking the guest's smart phone and sending a notification to the host system and/or facility management and/or hosting resident if the guest's smart phone is determined to be in the facility after the anticipated visit period.

Vendors may be provided (e.g., via the host server and cloud) with a vendor app 1032*a* for download to the vendor's portable electronic device (e.g., smart phone) 1032 that may have some limitations and/or additional features compared to a resident user app. For example, the vendor app may give vendor easy access to digital keys for the facility, maps/directions of the facility, ads/coupons, etc. Accessibility for the vendor (e.g., the ability to open specific doors/gates, dates and times of access to facility areas, etc.) may be subject to approval by the hosting resident and/or the management company. For example, a resident may use the resident's smart phone app to provide (via the resident smart phone and the host server) a vendor's smart phone app with specific access capabilities, such as granting access to specific areas on specific dates/times. Facility management may, via the management portal, provide a vendor's smart phone app with specific access capabilities, such as granting access to specific areas on specific dates/times, as well as instructions or other info regarding the specific maintenance to be conducted. The vendor app may keep track of a vendor's location and provide location data to the host server, and may provide location data as well as updates (e.g., via the host server) as to when the vendor arrives and departs the facility. The vendor location data and updates can be provided by the host server to facility management and/or the resident whom is hosting the particular vendor. The vendor app can also provide info to the host system and/or facility management and/or hosting resident if a vendor overstays from the anticipated duration of visit, by tracking the guest's smart phone and sending a notification to the host system and/or facility management and/or hosting resident if the vendor's smart phone is determined to be in the facility after the anticipated visit period. The vendor app may also enable the vendor to update the progress of the maintenance, including when the maintenance is completed, with the updates provided via the host server to the facility management and/or hosting resident.

Passersby may be provided (e.g., via the host server and cloud) with a passerby app 1042*a* for download to the passerby's portable electronic device (e.g., smart phone) 1042 that may have various features, such as providing facility information and/or neighborhood information and/or business ads (e.g., coupons).

Prospective tenants may be provided (e.g., via the host server and cloud) with a prospective tenant app 1052*a* for download to the prospective tenant's portable electronic device (e.g., smart phone) 1052 that may have various features, such as providing facility information (e.g., apartment availability information) and/or limited facility access and/or neighborhood information and/or business ads (e.g., coupons). The prospective tenant app may grant time-date limited access to specific areas of the facility, such as access to facility common areas (e.g., pool, gym), facility office, unoccupied apartments for viewing potential renters, etc.

Facility staff may be provided (e.g., via the host server and cloud) with a staff app 1062*a* for the staff member's portable electronic device (e.g., smart phone) 1062 that may have various features, such as providing facility information, tenant information, prospective tenant information, maintenance requests/information/updates, tracking information on vendors, video/audio link to kiosk, remote opening of access points (e.g., gates and doors), vacant apartment information, etc.

Note that the system control company may provide access control services to many different facilities. Moreover, one or more or all of the various apps (e.g., guest, vendor, prospective resident, staff, etc.) may be used at one or more or even all of the different facilities, depending on the desires of the various facilities. For example, a prospective resident may use the prospective resident smart phone app to take tours of multiple facilities of the system control company—without having to load a separate app for each facility. But note that each tour of a different facility by a prospective resident may need separate clearance from the remote host server and/or local facility and/or local kiosk in order to grant the prospective tenant access to a tour of that particular facility.

Figure 11A:
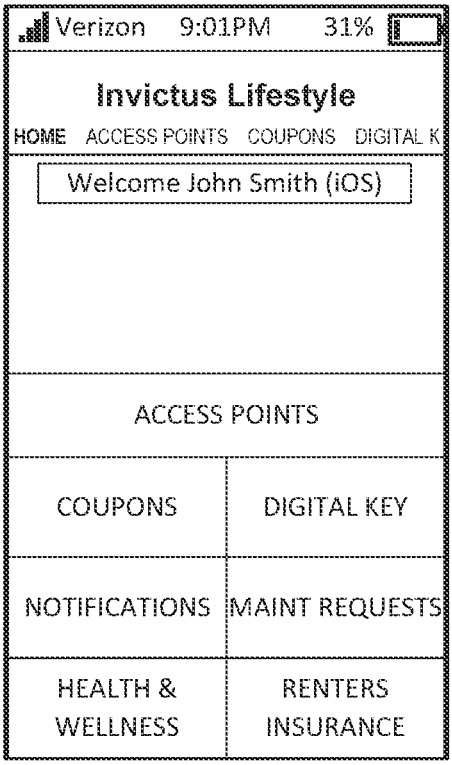
FIG. 11A depicts a home page screen according to an embodiment of the technology.
Figure 11B:
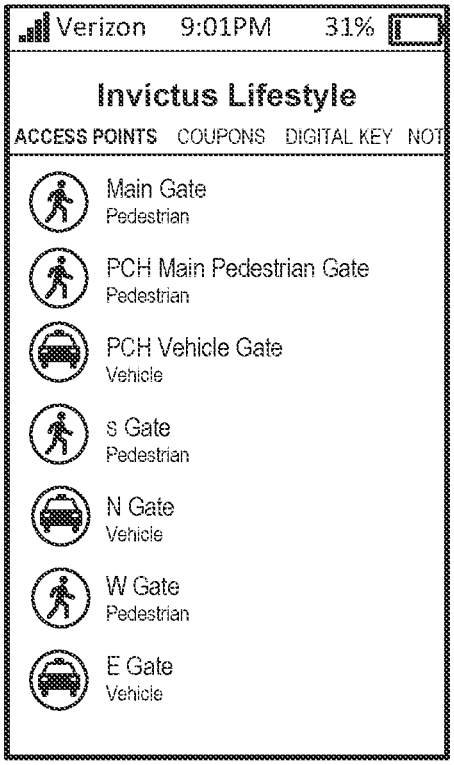
FIG. 11B depicts an access point screen according to an embodiment of the technology.
Figure 11C:
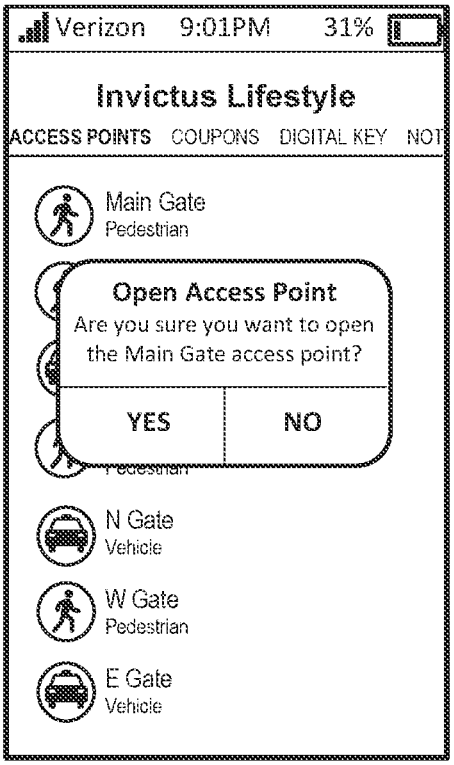
FIG. 11C depicts the access point screen of the embodiment of FIG. 11B with an access point confirmation.
Figure 11D:
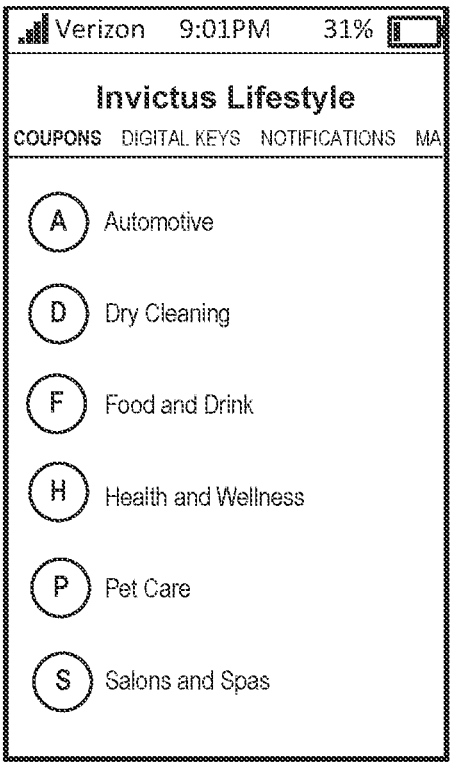
FIG. 11D depicts a coupon category screen according to an embodiment of the technology.
Figure 11I:
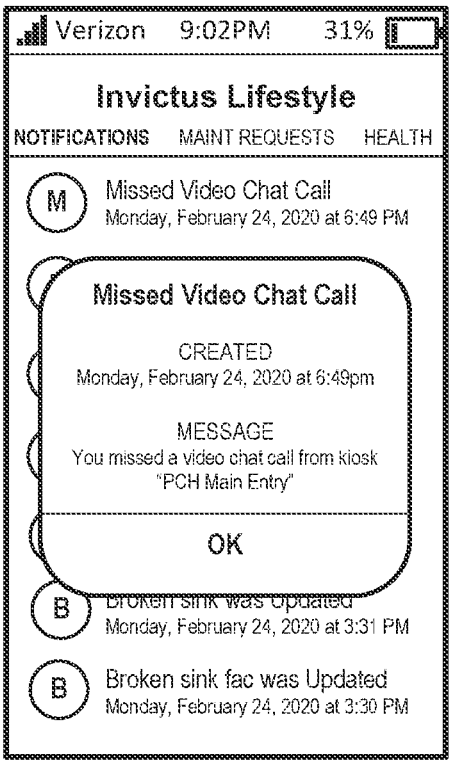
FIG. 11I depicts the notifications screen of the embodiment of FIG. 11H with a missed call details pop-up according to an embodiment of the technology.
Figure 11J:
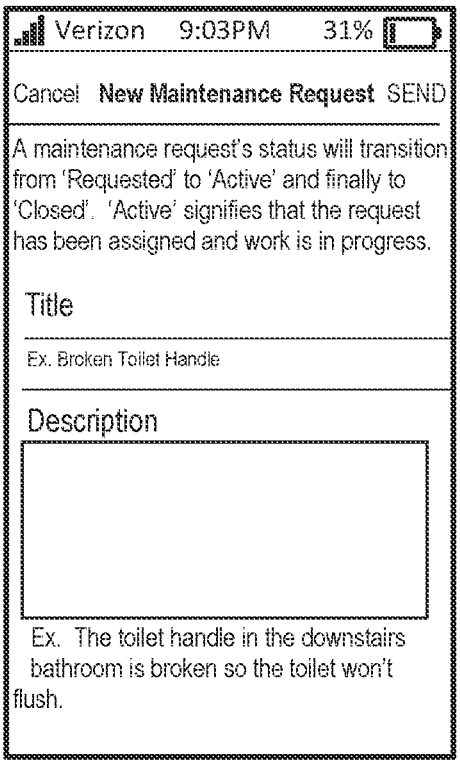
FIG. 11J depicts a new maintenance request screen according to an embodiment of the technology.
Figure 11K:
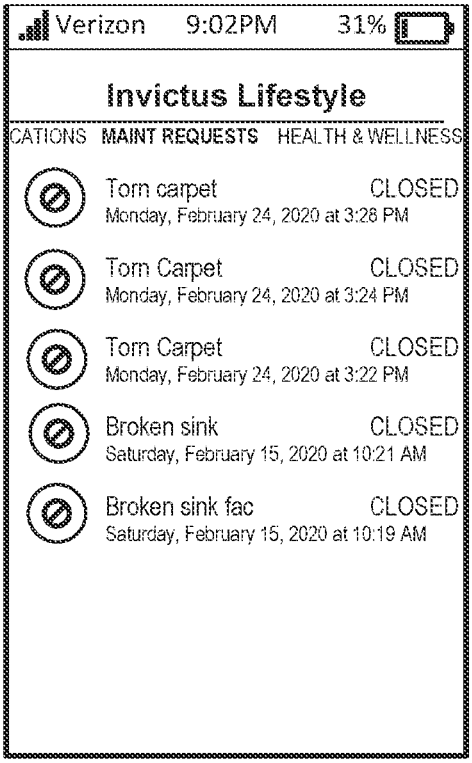
FIG. 11K depicts a maintenance request history screen according to an embodiment of the technology.
Figure 11L:
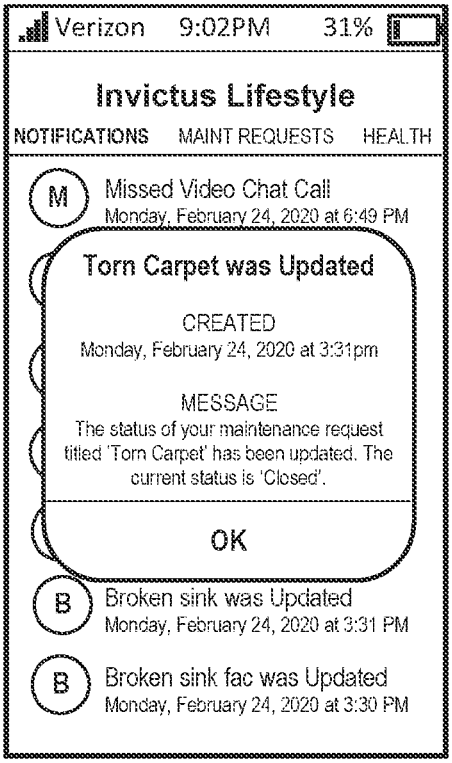
FIG. 11L depicts a maintenance request update screen according to an embodiment of the technology.
Figure 11M:
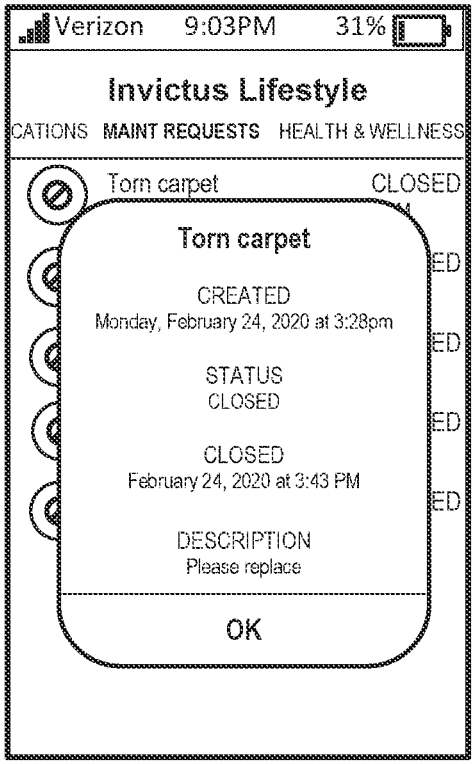
FIG. 11M depicts a maintenance request status screen according to an embodiment of the technology.

Examples of smart phone screen images of the technology are shown in FIGS. 11A-11P. FIG. 11A depicts a home page screen. FIG. 11B depicts an access point screen. FIG. 11C depicts the access point screen of the embodiment of FIG. 11B with an access point confirmation. FIG. 11D depicts a coupon category screen. FIG. 11E depicts a food and drink coupon screen. FIG. 11F depicts a vendor-specific coupon screen. FIG. 11G depicts a new digital key screen. FIG. 11H depicts a notifications screen. FIG. 11I depicts the notifications screen of the embodiment of FIG. 11H with a "missed call details" pop-up. FIG. 11J depicts a new maintenance request screen. FIG. 11K depicts a maintenance request history screen. FIG. 11L depicts a maintenance request update screen. FIG. 11M depicts a maintenance request status screen.

Note that each element of each embodiment and its respective elements disclosed herein can be used with any other embodiment and its respective elements disclosed herein.

All dimensions listed are by way of example, and devices according to the technology may have dimensions outside those specific values and ranges. The dimensions and shape of the device and its elements depend on the particular application.

Unless otherwise noted, all technical and scientific terms used herein have the same meaning as commonly understood by one of ordinary skill in the art to which this disclosure belongs. In order to facilitate review of the various embodiments of the disclosure, the following explanation of terms is provided:

The singular terms "a", "an", and "the" include plural referents unless context clearly indicates otherwise. The term "or" refers to a single element of stated alternative elements or a combination of two or more elements, unless context clearly indicates otherwise.

The term "includes" means "comprises." For example, a device that includes or comprises A and B contains A and B, but may optionally contain C or other components other than A and B. Moreover, a device that includes or comprises A or B may contain A or B or A and B, and optionally one or more other components, such as C.

Although methods and materials similar or equivalent to those described herein can be used in the practice or testing of the present disclosure, suitable methods and materials are described below. In case of conflict, the present specification, including terms, will control. In addition, the materials, methods, and examples are illustrative only and not intended to be limiting.

In view of the many possible embodiments to which the principles of the disclosed technology may be applied, it should be recognized that the illustrated embodiments are only examples of the technology and should not be taken as limiting the scope of the invention. Rather, the scope of the invention is defined by the following claims. We therefore claim as our invention all that comes within the scope and spirit of these claims.

What is claimed is:

1. A system for providing access to a controlled area, comprising:

a plurality of locks, each lock controlling access to a different access point of the controlled area;

a host server configured to receive resident and visitor information, the host server adapted to generate access data for use in activating one or more of the plurality of locks;

a cloud service server connected to the host server through an internet network, the cloud service server having a cloud storage;

a kiosk positioned at the controlled area, the kiosk connected to the cloud service server via an internet connection, the kiosk comprising a kiosk screen and a kiosk camera;

a resident smartphone app adapted to be provided to a resident smartphone via an internet network, the resident smartphone app adapted to provide resident access information to grant access to one or more resident access points, wherein the resident access information is generated using the access data generated by the host server, wherein the resident access points comprise one or more of the access points for the controlled area; and a non-resident smartphone app adapted to be provided to a non-resident smartphone via the internet network, the non-resident smartphone app adapted to provide non-resident access information for one or more non-resident access points, wherein the non-resident access information is generated using the access data generated by the host server, wherein the non-resident access points comprise one or more of the access points for the controlled area, wherein one or more of the resident access points are different from the non-resident access points, wherein the non-resident smartphone app is adapted to provide positioning data of the non-resident user smartphone, wherein the non-resident smartphone app is adapted to generate a first non-resident position alarm via the non-resident smartphone responsive to the non-resident positioning data indicating that the non-resident smartphone has entered an unauthorized area or has not moved for a first set period of time, wherein the system is adapted to generate a second non-resident position alarm responsive to the non-resident positioning data indicating that after a second set period of time the non-resident smartphone remains in the unauthorized area or has not moved, wherein the second non-resident position alarm comprises an audible alarm adapted to enable searchers to locate a user of the non-resident smartphone.

2. The system of claim 1, wherein the non-resident user smartphone positioning data is provided to the kiosk and the host server, wherein the kiosk locks or unlocks one or more of the plurality of locks responsive to the non-resident user smartphone positioning data.

3. The system of claim 1, wherein the kiosk is adapted to generate a kiosk non-resident position alarm responsive to the non-resident positioning data.

4. The system of claim 1, wherein the host server is adapted to generate a host server non-resident position alarm responsive to the non-resident positioning data indicating that the non-resident smartphone has not moved for a set period of time when in a portion of the controlled area where a user of the non-resident smartphone is authorized to traverse but not to linger.

5. The system of claim 1, wherein the resident smartphone app is adapted to provide resident facilities information regarding the controlled area; and wherein the non-resident smartphone app is adapted to provide non-resident facilities information regarding the controlled area, wherein the non-resident facilities information is different from the resident facilities information.

6. The system of claim 5, wherein the controlled area comprises a residential or commercial complex, and the non-resident facilities information comprises availability and rental rates for units in the residential or commercial complex.

7. The system of claim 1, wherein the non-resident smartphone app is adapted to generate a map of at least a portion of the controlled area for presentation on a screen of the non-resident smartphone.

8. The system of claim 7, wherein the map comprises a route for a non-resident to follow, wherein the route comprises directions generated by a processor using facility mapping data held in a memory.

9. The system of claim 1, wherein the non-resident smartphone app is adapted to generate a map of at least a portion of the controlled area for presentation on a screen of the non-resident smartphone, wherein the map includes a non-resident user location indicator, wherein the non-resident user location indicator is generated responsive to the positioning data of the non-resident user smartphone.

10. The system of claim 9, wherein the map comprises a route for a non-resident to follow.

11. The system of claim 10, wherein the route is updated responsive to positioning data of the non-resident user smartphone.

12. The system of claim 8, wherein the kiosk is adapted to generate a kiosk map of at least a portion of the controlled area for presentation on the kiosk screen, wherein the kiosk map comprises a route for the non-resident to follow.

13. The system of claim 1, wherein the host server is adapted to control and store a map of the controlled area.

14. The system of claim 1, further comprising:

a map database server adapted to host and provide map information of the controlled area, wherein the map database server is separately located from the host server, and wherein the map database server is separately controlled from the host server.

15. The system of claim 1, wherein the kiosk is adapted to generate a facility map of portions of the controlled area, wherein the kiosk is adapted to generate a non-facility map with directions to local businesses which are located outside of the controlled area, wherein the kiosk is adapted to generate advertisements for said local businesses, and wherein the resident smartphone app is adapted to provide advertising and coupons for one or more of said local businesses.

16. The system of claim 15, wherein the non-resident smartphone app is adapted to provide advertising and coupons for one or more of said local businesses.

17. A system for providing access to a controlled area, comprising:

a plurality of locks, each lock controlling access to a different access point of the controlled area;

a host server configured to receive resident and visitor information, the host server adapted to generate access data for use in activating one or more of the plurality of locks;

a cloud service server connected to the host server through an internet network, the cloud service server having a cloud storage;

a kiosk positioned outside of the controlled area, the kiosk connected to the cloud service server via an internet connection, the kiosk comprising a kiosk screen and a kiosk camera;

a first user smartphone app adapted to be provided to a first user smartphone via an internet network, the first user smartphone app adapted to provide first user access information to grant access to one or more first user access points, wherein the first user access information is generated using the access data generated by the host server, wherein the first user access points comprise one or more of the access points for the controlled area; and a second user smartphone app adapted to be provided to a second user smartphone via the internet network, the second smartphone app adapted to provide second user access information for one or more second user access points, wherein the second user access information is generated using the access data generated by the host server, wherein the second user access points comprise one or more of the access points for the controlled area, wherein one or more of the first user access points are different from the second user access points, wherein the second user smartphone app is adapted to provide second user positioning data of the second user smartphone, wherein the second user smartphone app is adapted to generate a first position alarm via the second user smartphone responsive to the second user positioning data indicating that the second user smartphone has entered an off-limits area or has not moved for a first set period of time, wherein the system is adapted to generate a second position alarm responsive to the second user positioning data indicating that for a second set period of time the second user smartphone remains in the off-limits area or has not moved, wherein the second position alarm comprises an audible or visual alarm adapted to enable searchers to locate a user of the second user smartphone.

18. The system of claim 17, wherein the second position alarm comprises a visual alarm, wherein the visual alarm comprises a flashing light.

19. The system of claim 17, wherein the second position alarm comprises an audio alarm, wherein the audio alarm comprises a siren or voice announcement.

20. The system of claim 17, the second user app is adapted to provide data regarding the condition of the user of the second user smartphone.

* * * * *